US011638863B2

(12) United States Patent
Baer et al.

(10) Patent No.: US 11,638,863 B2
(45) Date of Patent: May 2, 2023

(54) SYSTEMS AND METHODS FOR DETECTING PHYSICAL IMPACTS

(71) Applicants: Thomas Michael Baer, Mountain View, CA (US); Jonathan William Baer, Mountain View, CA (US)

(72) Inventors: Thomas Michael Baer, Mountain View, CA (US); Jonathan William Baer, Mountain View, CA (US)

( * ) Notice: Subject to any disclaimer, the term of this patent is extended or adjusted under 35 U.S.C. 154(b) by 0 days.

(21) Appl. No.: 17/376,921

(22) Filed: Jul. 15, 2021

(65) Prior Publication Data

US 2022/0016508 A1 Jan. 20, 2022

Related U.S. Application Data

(60) Provisional application No. 63/052,728, filed on Jul. 16, 2020.

(51) Int. Cl.

| | |
|---|---|
| ***A63B 69/32*** | (2006.01) |
| ***A63B 71/06*** | (2006.01) |
| ***A63B 24/00*** | (2006.01) |

(52) U.S. Cl.

CPC ..... *A63B 69/32* (2013.01); *A63B 24/0084* (2013.01); *A63B 71/0622* (2013.01); *A63B 71/0669* (2013.01); *A63B 2071/0647* (2013.01); *A63B 2220/53* (2013.01); *A63B 2220/58* (2013.01); *A63B 2220/62* (2013.01); *A63B 2220/806* (2013.01); *A63B 2220/808* (2013.01); *A63B 2220/833* (2013.01); *A63B 2225/74* (2020.08); *A63B 2244/102* (2013.01)

(58) Field of Classification Search

CPC ..... A63B 9/004; A63B 69/20–345

See application file for complete search history.

(56) References Cited

U.S. PATENT DOCUMENTS

| | | | | |
|---|---|---|---|---|
| 4,974,833 | A * | 12/1990 | Hartman | A63B 69/004 273/445 |
| 8,223,147 | B1 * | 7/2012 | El Dokor | G06F 3/011 345/424 |
| 8,337,366 | B2 * | 12/2012 | Jones | A63B 69/004 482/8 |
| 8,398,451 | B2 * | 3/2013 | Wolfe | A63H 3/001 446/175 |
| 8,602,949 | B2 * | 12/2013 | Pelletter | A63F 13/21 482/84 |
| 9,021,857 | B1 * | 5/2015 | Squire | A63B 69/32 73/12.04 |
| 9,227,128 | B1 * | 1/2016 | Carfagna, Jr. | A63B 24/0087 |

(Continued)

OTHER PUBLICATIONS

International Searching Authority, International Search Report and Written Opinion dated Oct. 20, 2021, issued in connection with International Patent Application No. PCT/US2021/041829, filed on Jul. 15, 2021, 10 pages.

*Primary Examiner* — Nyca T Nguyen

(74) *Attorney, Agent, or Firm* — McDonnell Boehnen Hulbert & Berghoff LLP

(57) ABSTRACT

The present disclosure relates to systems, devices, and methods for measuring physical impacts to various surfaces, including athletic equipment such as punching bags, tackling dummies, etc. An example system includes a punching bag and a plurality of force sensors coupled to the punching bag. The force sensors are configured to detect physical impacts on the punching bag.

19 Claims, 26 Drawing Sheets

(56) References Cited

U.S. PATENT DOCUMENTS 9,586,120 B1* 3/2017 Sotelo ..... A63H 13/06
9,782,652 B2* 10/2017 Williamson ..... A63B 71/0686
9,931,539 B1* 4/2018 de Pablos ..... A63B 69/201
10,124,227 B1 11/2018 Morin et al.
2005/0266967 A1* 12/2005 Considine ..... A63B 69/32 482/84
2005/0288159 A1* 12/2005 Tackett ..... A63B 69/32 482/84
2006/0252608 A1* 11/2006 Kang ..... A63B 69/0053 482/84
2007/0213182 A1* 9/2007 Anderson ..... A63B 69/004 482/83
2008/0215285 A1* 9/2008 Bucar ..... A63B 69/32 702/139
2008/0260299 A1* 10/2008 Ng ..... A63B 69/208 383/3
2009/0048069 A1* 2/2009 Sheedy ..... A63B 69/201 482/8
2010/0130329 A1* 5/2010 Sullivan ..... A63B 69/34 482/4
2010/0144414 A1 6/2010 Edis et al.
2011/0159939 A1* 6/2011 Lin ..... A63B 69/32 463/8
2011/0172060 A1* 7/2011 Morales ..... A63B 69/004 482/8
2011/0245045 A1* 10/2011 Blaies ..... A63B 69/34 482/84
2012/0053016 A1* 3/2012 Williamson ..... A63B 24/0062 482/8
2014/0206504 A1* 7/2014 Barreras ..... A63B 69/32 482/8
2014/0366645 A1* 12/2014 Tsai ..... G01L 5/0052 73/862.041
2015/0094191 A1* 4/2015 Fradin ..... A63B 24/0062 482/8
2016/0074734 A1* 3/2016 Tsai ..... A63B 24/0062 482/8
2017/0036087 A1* 2/2017 Codrington ..... A63B 69/32
2018/0015328 A1 1/2018 Fradin
2018/0161657 A1* 6/2018 Direnzo ..... A63B 69/208
2019/0038932 A1* 2/2019 Eckblad ..... G09B 19/0038
2019/0388760 A1* 12/2019 Morin ..... A63B 71/0622

* cited by examiner $$\text{Jerk} = \frac{F_{90\%} - F_{10\%}}{T_{90\%} - T_{10\%}}$$

$$\text{Peak Force} = F_{peak}$$

$$\text{Shove} = F_{peak} * (T^2_{10\%} - T_{10\%})$$

1220

During Workout

Round 1 of 10

2:31

Total Strikes:24

Punch: Left Hook

Peak(P): 1.78
Jerk(J): 0.13
Shove(S): 0.20

Last 5 Punches

Calories burned (approx) :45

| | |
|---|---|
| Left Hook | P:1.56, J:0.20 S:0.31 |
| Cross | P:1.23, J:0.32, S:0.29 |
| Jab | P:1.12, J:0.19, S:0.21 |
| Jab | P:1.15, J:0.21, S:0.22 |
| Overhand | P:1.80, J:0.09, S:0.15 |

1400

Strike Race

Total Strikes (entire workout)

Calories burned (approx)

Round 1 1:43

Laps Complete: 8

Power Threshold: 1.2 + -

Fastest Lap - 3.5 seconds

Avg Punch Stats during last lap

P:1.5, J:0.15, S:0.21

Avg Punch Stats (total)

P:1.2, J:0.23, S:0.25

1600

Combination Builder

| | |
|---|---|
| Jab | Cross, Hook(Adv), Hook-Body(Adv) Lead Uppercut (Adv), Rear Uppercut, Overhand |
| Cross | Hook, Lead Uppercut, Hook-Body, Rear Uppercut(Adv), Jab (Adv), Overhand (Adv) |
| Hook | Cross, Jab(Adv), Overhand, Hook-Body, Lead Uppercut (Adv), Rear Uppercut |
| Lead Uppercut | Cross, Hook(Adv), Hook-Body(Adv), Overhand, Jab (Adv) |
| Rear Uppercut | Jab (Adv), Hook, Cross(Adv), Lead Uppercut, Hook-Body(Adv), Overhand (Adv) |
| Overhand | Lead Uppercut, Hook, Cross(Adv), Jab (Adv), Hook-Body |

Figure 16

1900

Subscription Model

| | Private Client | Boxing Trainer | Gym Platform |
|---|---|---|---|
| Global Leaderboards | ✓ | ✓ | ✓ |
| Advanced Statistics | ✓ | ✓ | ✓ |
| Workout Programs | ✓ | ✓ | ✓ |
| System Updates | ✓ | ✓ | ✓ |
| Product Replacement | ✓ | ✓ | ✓ |
| PunchScore System | ✗ | ✓ | ✓ |
| Customizable Workout | ✗ | ✓ | ✓ |
| Group Class Metrics | ✗ | ✗ | ✓ |
| Gym Leaderboards | ✗ | ✗ | ✓ |
| Multi-bag Platform | ✗ | ✗ | ✓ |

Figure 19

SYSTEMS AND METHODS FOR DETECTING PHYSICAL IMPACTS

CROSS-REFERENCE TO RELATED APPLICATION

The present application claims the benefit of U.S. Provisional Patent Application No. 63/052,728, filed Jul. 16, 2020, the content of which is herewith incorporated by reference.

BACKGROUND

Striking a punching bag is a fundamental exercise for improving martial arts techniques. The resistance of a punching bag is designed to simulate the striking of a human target and to practice generating large amounts of force. Virtually any martial arts technique involving a limb strike (fist, elbow, knee, kick, even headbutts) can be practiced on a punching bag. Despite the range of techniques that can be practiced using this tool, limitations on an individual's technical improvements exist; due in part to the simplicity of the traditional punching bag concept.

Even with the help of an experienced martial arts instructor, the feedback and technical knowledge gained by observing an individual striking a punching bag is limited by the expertise of the trainer and their ability to diagnose biomechanical changes in technique that may improve their power, speed, and technical ability. If the trainer is not skilled in making adjustments to biomechanical factors including body rotation, range, footwork, transference of body weight, kinetic chain, and proper starting position, the martial arts practitioner's technique may stagnate and/or not improve over time even with constant coaching.

Conventional impact force systems may use sensors to quantify the impact force (e.g., maximum force, average force, etc.) of a punch, kick, or other athletic or physical strikes.

There exists a need for tools to measure the power and efficiency of martial arts strikes that provide immediate feedback and the ability to self-assess without the direct assistance of trained martial arts instructors. Additionally or alternatively, instructors could monitor, track, or otherwise utilize the collected data to help trainees improve athletic performance.

SUMMARY

The present disclosure generally relates to systems and methods for measuring forces and transients associated with punches, kicks, and other physical impacts.

In a first aspect, a system is provided. The system includes a punching bag and a plurality of force sensors coupled to the punching bag. The force sensors are configured to detect physical impacts on the punching bag.

In a second aspect, a method is provided. The method includes receiving, from at least one force sensor, information indicative of one or more physical impacts. The at least one force sensor is coupled to a device body configured to be removably coupled to a coupling surface. The method additionally includes determining, based on the received information, at least one of: a peak force, a jerk time, or a momentum value.

In a third aspect, a device is provided. The device includes a device body configured to be removably coupled to a coupling surface. The device also includes at least one force sensor coupled to the device body. The at least one force sensor is configured to detect physical impacts to the coupling surface. The device additionally includes a controller having at least one processor and a memory. The at least one processor executes program instructions stored in the memory so as to carry out operations. The operations includes receiving, from the at least one force sensor, information indicative of one or more physical impacts. The operations also include determining, based on the received information, at least one of: a peak force, a jerk time, or a momentum value.

Other aspects, embodiments, and implementations will become apparent to those of ordinary skill in the art by reading the following detailed description, with reference where appropriate to the accompanying drawings.

BRIEF DESCRIPTION OF THE FIGURES

FIG. 16 illustrates a combination builder graphical user interface, according to an example embodiment.

FIG. 19 illustrates a subscription model graphical user interface, according to an example embodiment.

DETAILED DESCRIPTION

Figure 1:
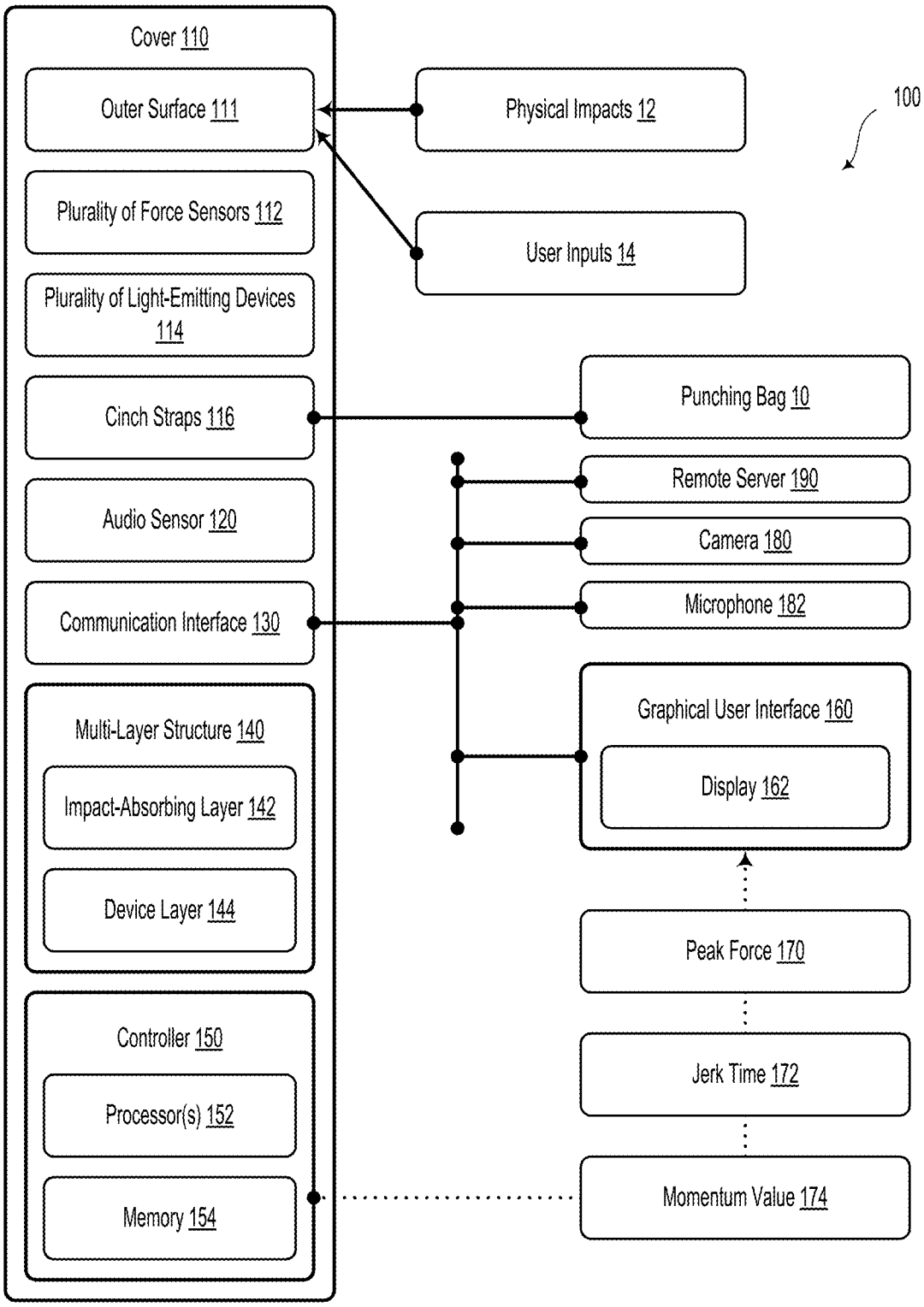
FIG. 1 illustrates a system, according to an example embodiment.

Example methods, devices, and systems are described herein. It should be understood that the words "example" and "exemplary" are used herein to mean "serving as an example, instance, or illustration." Any embodiment or feature described herein as being an "example" or "exemplary" is not necessarily to be construed as preferred or advantageous over other embodiments or features. Other embodiments can be utilized, and other changes can be made, without departing from the scope of the subject matter presented herein.

Thus, the example embodiments described herein are not meant to be limiting. Aspects of the present disclosure, as generally described herein, and illustrated in the figures, can be arranged, substituted, combined, separated, and designed in a wide variety of different configurations, all of which are contemplated herein.

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

I. Overview

Examples described herein include systems and methods for measuring the forces associated with various physical movements such as: punches, kicks, tackles, jumps, etc. The measurements described herein can be analyzed (e.g., with a computing device) to provide important diagnostic information to athletes, athletic trainers, doctors, and patients. Measurements of such forces and the locations of where such forces are applied can be used to characterize athletic performance, track recovery from injury, among other applications.

In an example embodiment, a force-sensing punching bag attachment or cover can be utilized to measure punching power. Punching power cannot be accurately measured or described by a standardized unit, such as pounds per square inch (psi) or pound-force (lbf). Rather, calculating the precise physics of a punch involves accounting for the bodyweight of the striker, the dimensions of the fist/glove, velocity, rise time (also known as jerk time), peak force, transient (time the fist/glove spends in contact with the target), transference of bodyweight, distance to target, and efficiency of the athlete's kinetic chain. An untrained 200 lb person may generate the same peak force as a highly trained 145 lb boxer, but if the rise time (jerk time) is much slower due to technical deficiencies, the punch will have less concussive impact and reduced efficacy, despite registering similar numbers in psi or lbf scales.

As described herein, the rise time (jerk time) can be measured from the time the strike makes initial contact with the bag until the peak force of the strike is registered, both indicated by the force sensor readings. This is a very important metric in determining the efficacy of a strike. A shorter rise time indicates more speed, power, efficacy of movement and concussive impact.

Additionally, as described herein, the peak force of the strike can be defined as the largest voltage/current reading on the force sensor during the strike. This reading can be correlated with a maximum force created by the strike impacting the bag.

Furthermore, as described herein, the transient is defined as the total amount of time that the strike is in contact with the bag. A short transient signal indicates that the strike spent little time in contact with the bag. Generally, the short transient signal may indicate a more effective strike while a longer transient signal may indicate a less effective strike that involves more "pushing" motion than clean impact. Certain strikes are exceptions and will have longer transients by design. These strikes include knee strikes and push kicks and will not necessarily improve efficacy by shortening the transient. In other words, punch efficacy or quality may be quantified by the peak force and the rise time of the force signal and, potentially, the momentum transfer. Longer contact with the punching bag may result in greater momentum transfer to the strike surface. The rise time or jerk characteristic of a given strike may indicate its concussive force. Different strike types may have different intended effects. In various embodiments, utilizing force sensor signals to distinguish between and quantify the different strike types may be leveraged to improve athletic performance through training.

Example systems and devices described herein may include a plurality of force sensors, which may utilize force-sensing resistors, load sensors, or piezoelectric sensors. Such systems and devices may be configured to record real-time force data while a punch, kick, or other physical blow is being applied to a punching bag or impact-sensing device.

In some embodiments, systems and devices described herein could include a multi-layered blanket-like wrap that is composed of an 18"×72"×⅜" Shocktec impact-absorbing gel with a layer of force-impact velostat sensors attached to circuit boards underneath. Beneath the force sensors is an additional layer of 24"×60"×⅜" Shocktec Air2Gel that provides additional shock absorption to prevent injury to the user. This wrap fits tightly against the punching bag, secured by cinch straps, and can be attached to any commercial punching bag of standard dimensions above 80 lbs.

In various embodiments, the punching bag wrap could include 4 force sensors placed along the top half of the wrap to absorb the main types of strikes to the head/upper torso—jab, cross, lead hook, rear hook/overhand, and lead/rear elbows. An additional 3 force sensors around the middle of the bag are designed to absorb uppercuts, jab or straight punches to the body, lead/rear hooks to the body as well as kicks and knee strikes.

The usable feedback from a traditional punching bag is limited to the movement of the bag, the sound of the strike hitting the bag, and the striker's anecdotal "feel" of the strike. This deficiency in training is particularly apparent with self-taught martial artists, or enthusiasts that exercise using a punching bag by themselves and do not receive outside coaching or instruction. Without third-party coaching, an individual's sole forms of technical feedback while using a punching bag are anecdotal auditory, visual, and physical cues—"that punch 'felt' better, that kick 'sounded' right" or judging how much the punching bag swings on impact. Judging the efficacy of strikes based on the swing of a heavy bag is a common error amongst hobbyists and self-taught martial artists. It can result in diminished technique because the bag swings harder when strikes have a higher transient, creating a "pushing" impact while the lack of swing generally indicates a crisp, powerful, and more technically correct strike with higher jerk and lower transient.

The metrics and data collected from the force sensors displayed in the associated workout analysis software can help martial arts practitioners improve their technique by giving real-time feedback on striking power, reaction time, average time between strikes, as well as detailed strike-specific analytics.

Systems and devices described herein could include a light-emitting diode (LED)-based targeting system that is overlaid on the same circuit board as each of the force sensors used to indicate specific targets on the punching bag. This system helps give accurate force sensor readings by guiding the striker to hit the force sensor cleanly, as opposed to partial/incomplete strikes that may give inaccurate or incomplete force readings. This LED system can be utilized for a variety of workout programs, interactive striking games, and to increase the accuracy, power, reaction time, and speed of strikes.

The force sensors and their accompanying software may be used to record strike data while the LED system is used to indicate specific sensors to target with strikes. Certain programs will only turn the LED light off when at least one of: a specified power threshold, predetermined rise time, and/or predetermined momentum value is recorded on the force sensor. This scalable power threshold system is a novel training tool because of the immense variability in striking power among martial arts practitioners. The power difference between a 125 lb practitioner versus a 200 lb+ practitioner can be immense and this system can scale the difficulty in turning the LED lights out, in real time, based on the size and experience level of the user.

The LED workout programs are designed by a mixed martial arts (MMA) coach with over 15 years of experience training professional kickboxers, boxers, and MMA fighters. This specialized knowledge can give solo practitioners the experience of high-level coaching by drilling effective strike combinations and trying to match the timing and power thresholds indicated by the selected LED workout program.

The LED system also functions as a novel way to control the workout software programs. One of the challenges of incorporating cell phone-based workout programs in boxing workouts is the necessity of the user removing their gloves to interact with the workout program interface. This is especially time consuming and workout diminishing if the boxing gloves are lace-ups versus velcro hook-and-loop. Users will be able to initiate, pause, end, or skip to a new section of workouts by hitting sensors in a specific order.

After a strike assessment is completed, a full summary of the strikes landed will be displayed on the computer/app GUI. The strike assessment summary may include information about the force transient, force rise time, peak force, momentum transfer (e.g., time integral of force transient), and reaction time of each individual strike, as well as the averages of each metric and scalable graphs showing the strikes landed during the program. If video review has been enabled, the user will have the option to upload video of the assessment that syncs with the data files. The results from this program will be stored locally and transmitted to remote servers. Analytics from every user's strike assessments could provide valuable metrics including power/speed percentiles based on age/height/weight and the ability to measure themselves globally against all other users.

Such statistics from multiple users will allow for expanded data analysis on martial arts techniques. Practitioners from any discipline can compare their own data from the strike assessments and workouts to others within their demographic and to the entire global database. Competitions based on this real-time data can be held to determine the hardest, or fastest, strikes in the world. The Video review system within the app provides novel anti-cheat verification by only considering participants that submit video evidence of their strikes (to prevent someone winning by hitting the bag with a baseball bat, etc.).

In some embodiments, systems and devices described herein could provide the ability to synchronize video with recorded strike data within the GUI. During any open workout and strike assessment modes, a third party (or tripod system) can capture video of the user while they are completing the program. After the program is completed, this video can be added to a section within the GUI which will synchronize the playback with the respective data file of their strike data. A toggle able slider bar could be provided so as to provide frame-by-frame interactive visual analysis of the strike techniques while the corresponding individual strike statistics are displayed next to it. This provides high level of biomechanical analysis for practitioners of martial arts techniques and other types of athletes.

A distinguishing feature between conventional punch-measuring machines and the present systems, devices, and methods is the calculation of real force units as opposed to using arbitrary units. As an example, arcade-style punching machines may provide an output value of between 1 to 999. Some in-glove accelerometer based "power" sensors provide values from a scale of 1-5. Other conventional systems utilize other arbitrary or made-up units of measurement. Yet further, the Professional Fighters League (PFL) measures strike speed in miles per hour as one of their main metrics during TV broadcasts. However, the different conventional metrics cannot be translated between systems and such metrics often measure different aspects of the physical strike. The present systems, devices, and methods combine the measurements of three force and timing variables—peak, jerk, and shove forces to provide a quantitative way (e.g., using CGS units or another type of well-accepted, standardized unit) to assess strike impacts.

II. Example Systems

FIG. 1 illustrates a system 100, according to an example embodiment. System 100 could include a force-sensing punching bag attachment or cover. For example, the system 100 could include a cover 110 that is configured to be removably coupled to a punching bag 10. The cover 110 includes a plurality of force sensors 112 configured to detect physical impacts 12.

In some examples, the force sensors 112 could include any type of force transducer that could be configured to provide near-real time force measurement data. In such scenarios, physical impacts 12 generated by a punch, kick, or other physical strike could be quantified using a force sensor 112 coupled to a fast analog to digital converter (ADC) 156 and a digital computer. An example of a suitable A/D device is a Measurement Computing A/D model USB-202. Such devices are capable of performing approximately 100,000 A/D conversions per second, which may beneficially provide sufficient time resolution to accurately record the forces applied to the outer surface 111 of the cover 110. A suitable ADC may be capable of digitizing several different voltages (e.g., 8 different voltages), which can be used to monitor the forces over a plurality of force sensors 112. A suitable computer is manufactured by Dell Corporation Model XPS 15 with a high speed USB 2.0 interface, which could be configured to accept the high speed data from the ADC. It will be understood that other types of force sensors are possible and contemplated.

In some embodiments, system 100 also includes a controller having at least one processor 152 and a memory 154. The at least one processor 152 executes program instructions stored in the memory 154 so as to carry out operations. In some embodiments, the controller 150 could include at least one of a field-programmable gate array (FPGA) or an application-specific integrated circuit (ASIC). Additionally or alternatively, the controller 150 may include one or more processors 152 and a memory 154. The one or more processors 152 may include a general-purpose processor or a special-purpose processor (e.g., digital signal processors, etc.). The one or more processors 152 may be configured to execute computer-readable program instructions that are stored in the memory 154.

The memory 154 may include or take the form of one or more computer-readable storage media that may be read or accessed by the one or more processors 152. The one or more computer-readable storage media can include volatile and/or non-volatile storage components, such as optical, magnetic, organic or other memory or disc storage, which may be integrated in whole or in part with at least one of the one or more processors 152. In some embodiments, the memory 154 may be implemented using a single physical device (e.g., one optical, magnetic, organic or other memory or disc storage unit), while in other embodiments, the memory 154 can be implemented using two or more physical devices.

As noted, the memory 154 may include computer-readable program instructions that relate to operations of system 100. As such, the memory 154 may include program instructions to perform or facilitate some or all of the functionality described herein. The controller 150 is configured to carry out operations. In some embodiments, controller 150 may carry out the operations by way of the processor 152 executing instructions stored in the memory 154.

The operations include receiving, from at least one of the force sensors 112, information indicative of one or more physical impacts 12.

The operations additionally include determining, based on the received information, at least one of: a peak force 170, a jerk time 172, or a momentum value 174.

In the case of a punch impact, one or more of the force sensors 112 could provide an electrical signal in response to a first or glove impacting the punching bag 10 and cover 110. In such a scenario, the jerk time 172 could be calculated from the time the first or glove makes initial contact with the bag until the peak force 170 is registered, both indicated by the force sensor readings. As described herein, a shorter rise time of the force transient indicates more speed, power, efficacy of movement, and concussive impact. The peak force 170 (and corresponding peak time) could be determined based on a maximum value of a current or voltage signal received from one or more of the force sensors 112. The maximum value of the current or voltage signal could be utilized to determine the maximum force created by a strike impacting the bag.

In some embodiments, the momentum value 174 can be calculated based on Newton's second law of motion written in terms of a change in momentum.

$$F_{net} = \frac{\Delta p}{\Delta t}, \tag{1}$$

which can also be written as $$\Delta p = \frac{F_{net}}{\Delta t} \tag{2}$$

where $F_{net}$ represents the magnitude of the net external force in units of Newtons (1 kg·m/s$^2$), Δp is the change in momentum in units of kg·m/s, and Δt is the change in time (e.g., transient time between initial impact of punch and release) in seconds. In such a scenario, the momentum value 174 or "shove" could be determined based on the external force as a function of time. In some embodiments, the momentum value 174 could be calculated based on the time integral of the force applied to the punching bag 10, and which can be approximated by the product of the peak force times the full width half maximum (FWHM) of the force versus time waveform.

In various examples, the momentum value 174 can alternatively be calculated based on the mass of the punching bag 10 and change in its velocity. Using the definition of a change in linear momentum:

$$\Delta p = m\Delta v \tag{3}$$

where m is the mass of the punching bag 10 in kilograms. In some embodiments, the momentum value 174 could be calculated by the integral of force measurement over the duration of the strike. In such scenarios, the momentum value 174 could be termed the "shove" or the "shove value".

In some embodiments, the jerk or jerk time 172 could be estimated by the maximum of the slope of the force transient times the peak force. Additionally or alternatively, the jerk time 172 could be based on an instantaneous slope at a midpoint between 10% and 90% values of the force transient signal that corresponds to the strike. As a further alternative, the jerk could be calculated based on the slope at a half-maximum point of the force transient signal. Other slope calculations and/or derivative functions could be applied to various portions of the force transient signal to provide a jerk value. In various embodiments, the peak force 170, jerk time 172, and/or momentum value 174 could be used—jointly or individually—to assess a user's physical strikes. In such scenarios, assessing a user's strikes could be done by scoring one or more physical strikes. The scoring could be based on measured attributes of physical strikes, as described herein. For example, a punch with a high peak force 170, low jerk time 172, and high momentum value 174 could be scored higher than a punch with a relatively lower peak force 170, longer jerk time 172, and lower momentum value 174. It will be understood that scoring could include a numerical value, a letter "grade", a color (e.g., green, yellow, or red), or some other type of performance designator. Additionally or alternatively, the scoring could be indicated by a color and/or intensity change in the corresponding LED target.

In various embodiments, the plurality of force sensors 112 is further configured to provide information indicative of a user input 14. In such scenarios, the operations additionally include determining, based on the information indicative of the user input 14, a desired operating mode.

In some embodiments, system 100 also includes a camera 180 configured to capture one or more images of physical impacts 12 to the cover 110. In such scenarios, the system 100 could additionally include a graphical user interface 160 configured to display (via a display 162) the one or more images and corresponding spatio-temporal information about the physical impacts 12. As an example, high-frame rate, slow-motion video with overlaid force sensor information (e.g., force versus time information) could be used to provide illustrative training videos. Such training videos may provide an athlete with quantitative feedback and suggest ways to improve.

In some embodiments, the cover 110 additionally includes a plurality of light-emitting devices 114. In such scenarios, the plurality of light-emitting devices 114 is configured to indicate strike targets on the punching bag 10.

In example embodiments, the plurality of light-emitting devices 114 could be further configured to indicate a plurality of user-selectable operating modes. In such scenarios, the user-selectable operating modes could include at least one of: a random operating mode, a workout mode, a proficiency-dependent mode, or an activity-specific mode. In other words, a combination of the light-emitting device 114 and the force sensors 112 could be utilized as a "touch pad" or "punch pad" for data input to choose workout routines or otherwise control various operational aspects of system 100. Additionally or alternatively, during a reaction time measurement mode (e.g., "whack-a-mole" mode), the plurality of light-emitting devices 114 could be configured to provide reaction targets and the force sensors 112 could be configured to measure reaction strikes.

In some embodiments, workout routines could include various combinations of punches and kicks (e.g., left jab/right cross/left hook/roundhouse kick). In such scenarios, a first light-emitting device could be activated in order and stay lit for a predetermined amount of time before switching to a next light-emitting device, and so on. In some embodiments, the next light-emitting device could be triggered by "punching out" the illuminated light-emitting device. In some embodiments, the light-emitting devices 114 could be configured to illuminate with a specific color indicating a strike sequence. Additionally or alternatively, the light-emitting devices 114 could change color when a user strikes the targets in a specific order and/or when the users' strikes exceed a threshold or goal value for a jerk force, a peak force, or a momentum "shove".

In various embodiments, the plurality of force sensors 112 could be arranged in an array. In such scenarios, at least some of the force sensors could be arranged to simulate a physical form of a sparring partner.

In some embodiments, an outer surface 111 of the cover 110 could include markings or symbols that correspond to one or more of the force sensors 112. For example, the markings or symbols could indicate an outline of a sparring partner or another target shape.

In various embodiments, system 100 could include an audio sensor 120. In such scenarios, a user of system 100 could use voice commands to choose workout routines or otherwise control the operation of system 100.

In some embodiments, the cover 110 could include a flexible multi-layer wrap structure 140. In such scenarios, the flexible multi-layer wrap structure 140 could include at least one impact-absorbing layer 142. As an example, the impact-absorbing layer 142 could include a gel material. Furthermore, the flexible multi-layer wrap structure 140 could include at least one device layer 144. In such scenarios, the plurality of force sensors 112 could be coupled to the at least one device layer 144.

In examples that include a plurality of light-emitting devices 114, the plurality of light-emitting devices 114 could be coupled to the at least one device layer 144. In some examples, the at least one device layer 144 could include one or more circuit boards. In such scenarios, at least one light-emitting device and at least one force sensor could be coupled to a common circuit board of the one or more circuit boards. In some embodiments, the circuit boards and/or the at least one device layer 144 could include a flexible material, such as polymer or plastic, among other another pliable materials.

In example embodiments, at least one force sensor of the plurality of force sensors 112 is formed from a pressure-sensitive conductive material. In such scenarios, an electrical conductivity of the pressure-sensitive conductive material decreases in response to applied pressure (e.g., physical impacts 12).

In some embodiments, the cover 110 also includes at least one cinch strap 116. In such scenarios, the cover 110 is configured to be removably coupled to the punching bag 10 by tightening or loosening the at least one cinch strap 116 around the punching bag 10.

In various examples, system 100 could include a microphone 182. In such scenarios, could provide the ability to program workout routines using voice commands. Additionally or alternatively, an instructor or user could call out punches, either by number, or name (1=Jab, 2=Cross, 3=Hook, etc.) and the audio command could illuminate a corresponding light-emitting device 114. The microphone 182 and controller 150 could provide that a user may customize their heavy bag workouts to mimic training with a professional trainer that is calling out combinations and holding focus mitts. Furthermore, the disclosed system 100 could provide a functional workout system that can be specifically tailored for online streaming classes. In such a scenario, an online streaming boxing class of virtually unlimited participants could be led by a single instructor using such an interface, calling out combinations that could be displayed on a remote, network-connected system 100. In such scenarios, graphical user interface 160 could also display punch information of others in the streaming boxing class, live video of a class instructor and/or live video of other class participants. As an example, the graphical user interface 160 and display 162 could dynamically provide punch data of class participants (e.g., displaying a centralized class leaderboard). It will be understood that other ways to provide "smart punching bag" functionalities are contemplated and possible.

Figure 2A:
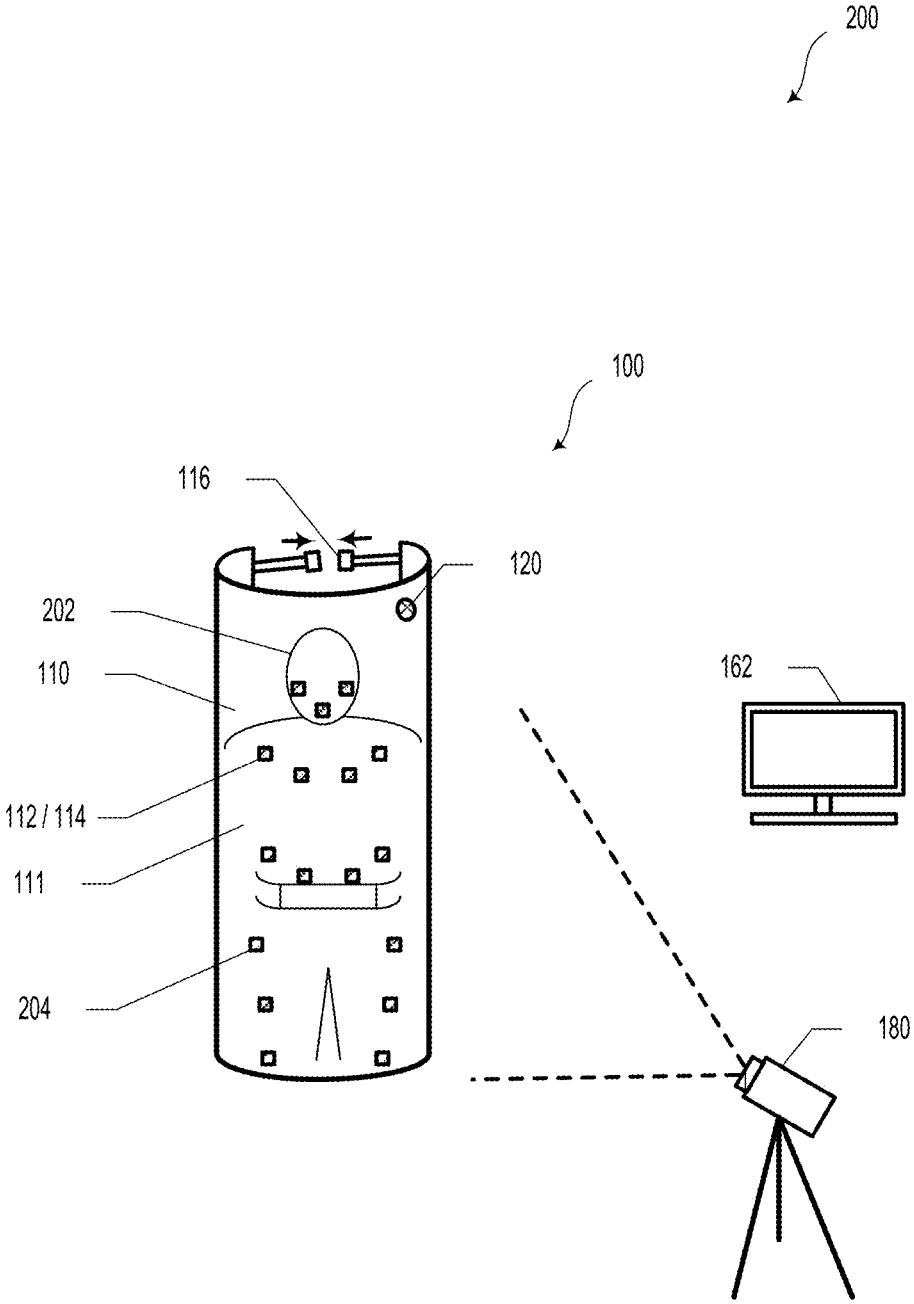
FIG. 2A illustrates an operating scenario involving the system of FIG. 1, according to an example embodiment.

FIG. 2A illustrates an operating scenario 200 involving the system 100 of FIG. 1, according to an example embodiment. Operating scenario 200 includes system 100, which includes at least one set of cinch straps 116. The cinch straps 116 could provide a way to fasten the cover 110 to a punching bag 10. The cinch straps 116 could include one or more fasteners (e.g., hook and loop fasteners, buckles, clasps, clamps, or other types of fasteners). It will be understood that while some embodiments described herein could represent detachable covers that could be selectively attached to a punching bag, other possibilities are contemplated as well. For example, in some examples, some or all elements of system 100 could incorporated into, or permanently attached to, a punching bag. That is, some or all of the force sensors, light-emitting devices, and/or other elements of system 100 could be permanently attached to the punching bag.

As a non-limiting example, an example system could include a punching bag (e.g., punching bag 10) and a plurality of force sensors (e.g., force sensors 112) incorporated into or coupled to the punching bag. Furthermore, in such scenarios, a controller (e.g., controller 150) and/or a plurality of light-emitting devices (e.g., light-emitting devices 114) could be incorporated into the punching bag as well.

As illustrated in operating scenario 200, an outer surface 111 of the cover 110 could include one or more strike targets 204 and/or an outline or an image of a sparring partner 202. As described elsewhere herein, the system 100 could include a plurality of force sensors 112 and a plurality of light-emitting devices 114. It will be understood that a single strike target 204 could represent a two-dimensional or three-dimensional region of the cover 110 where one or more force sensors 112 and one or more light-emitting devices 114 are proximate to one another or are otherwise substantially co-located.

In an example embodiment, each strike target 204 could include a plurality of light-emitting diodes (LEDs) arranged in a circular pattern around one or more force sensors. Other shape patterns are possible and contemplated. In such scenarios, the light-emitting diodes could provide immediate color-based feedback on a strike force level or range (e.g., green for low force range, yellow for medium force range, red for high force range). Additionally or alternatively, varying numbers of LEDs could be illuminated based on the strike force level or range of a given strike (e.g., one LED illuminated for low force range, eight LEDs illuminated for medium force range, 16 LEDs illuminated for high force range, etc.). Yet further, an intensity level of the plurality of LEDs could vary based on the force of a strike. It will be understood that other ways to utilize a plurality of color-adjustable LEDs to indicate a strike force, strike type, or other characteristics of a given strike are possible and contemplated.

In some embodiments, the system 100 could include one or more audio sensors 120. Additionally or alternatively, a camera 180 could be utilized to capture video of a field of view near the punching bag 10 and cover 110. In further embodiments, a graphical user interface 160 could be displayed via a display 162. In some embodiments, the display 162 could be a display of a mobile device, a smart phone, a tablet device, a laptop, a desktop computer, or another type of computing device.

Figure 2B:
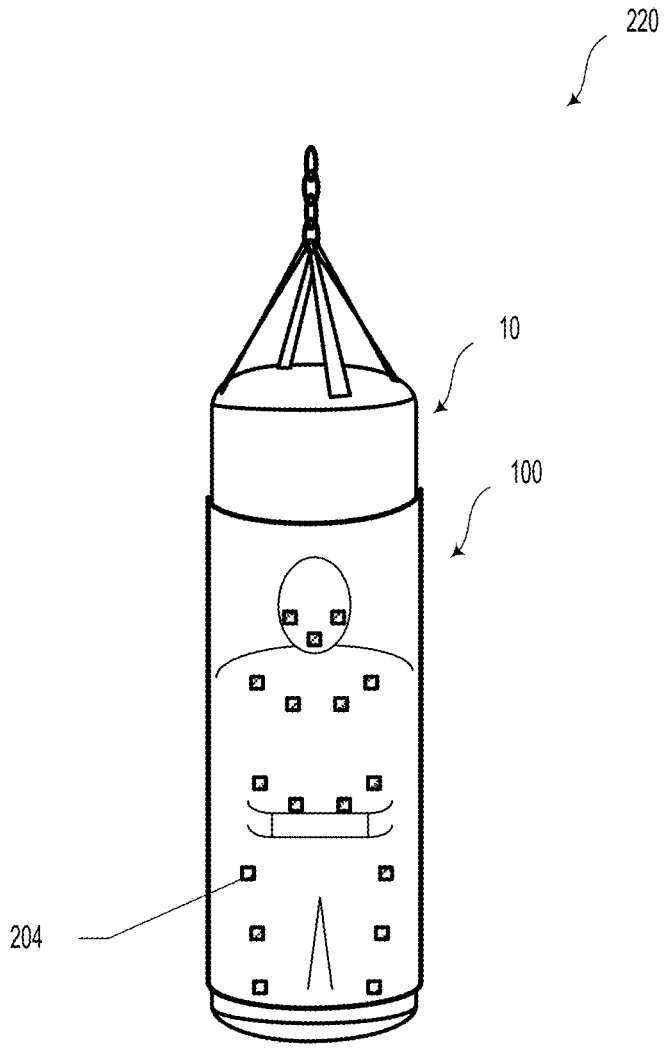
FIG. 2B illustrates an operating scenario involving the system of FIG. 1, according to an example embodiment.

FIG. 2B illustrates an operating scenario 220 involving the system 100 of FIG. 1, according to an example embodiment. The operation scenario 220 includes the system 100 attached to the punching bag 10. It will be understood that the system 100 and cover 110 could be attached to another object, such as an athletic target, a dummy, or a speed bag. While FIGS. 2A and 2B illustrate particular arrangements of strike targets 204, force sensors 112, and light-emitting devices 114, it will be understood that other arrangements of such elements are possible within the context of the present disclosure.

Figure 2C:
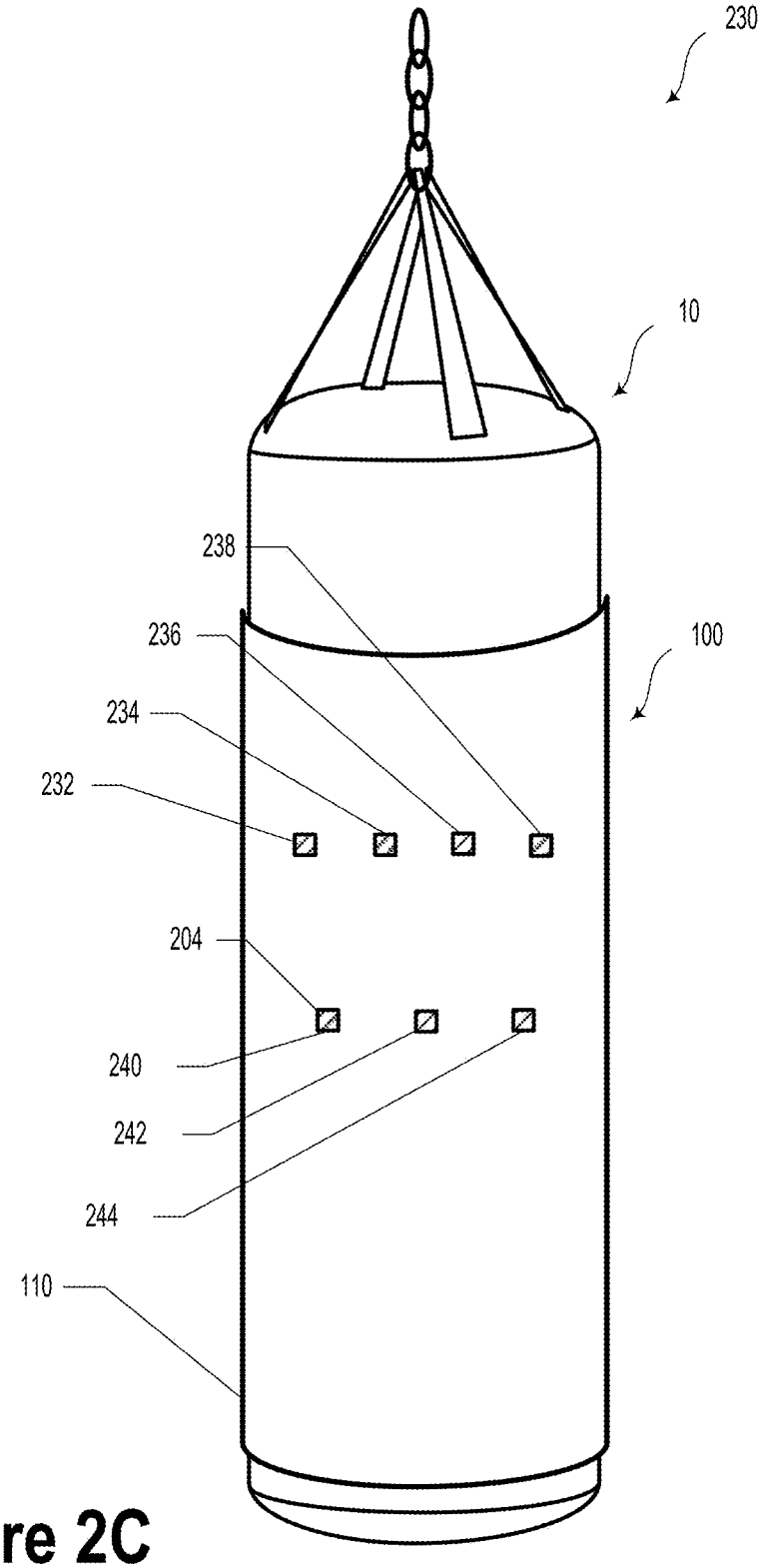
FIG. 2C illustrates an alternative arrangement of strike targets in the system of FIG. 1, according to an example embodiment.

FIG. 2C illustrates an alternative arrangement 230 of strike targets 204 in the system 100 of FIG. 1, according to an example embodiment. For example, the system 100 and the cover 110 could include seven strike targets 232, 234, 236, 238, 240, 242, and 244 arranged in two horizontal rows along the cover 110. In such a scenario, a top row could include four strike targets 232, 234, 236, and 238 that may be associated with head targets and a bottom row could include three strike targets 240, 242, and 244 that may be associated with chest targets.

In such scenarios, the placement of the respective strike targets 204 could provide that specific force sensor targets could be utilized to automatically detect a type of punch that is being thrown. For example, for a right handed (orthodox) user, the four head-level targets from left to right—Target 1 (strike target 232) could be associated with a left hook punch type, Target 2 (strike target 234) could be associated with a left jab punch type, Target 3 (strike target 236) could be associated with a right straight punch type, Target 4 (strike target 238) could be associated with a right hook/overhand punch type. Likewise, the body targets from left to right Target 5 (strike target 240) could be associated with a left hook/uppercut body punch type, Target 6 (strike target 242) could be associated with a straight body punch type, and Target 7 (strike target 244) could be associated with a right hook/uppercut body punch type.

Conventional punch tracking technology (e.g., using accelerometers in a boxer's wrist wraps) can track a total amount of punches but cannot specifically distinguish between punch types. For example, conventional punch tracking technology may be able to generally determine "looping-type" punches. However, such conventional system cannot distinguish between, for example, an uppercut punch and a hook punch. Example embodiments described herein may provide a way to determine specifically how many punches of a given punch type (e.g., left hooks) an athlete threw during a prior workout round, during the entire workout, or lifetime. Additionally or alternatively, embodiments described herein may provide a way to aggregate punch types (e.g., lump outputs together) by potential punch combinations. For example, system 100 may be configured to determine that a given punch combination (e.g., a jab-cross-hook "1-2-3" combination) produced an average of X force, average of Y jerk, etc. It will be understood that other ways to sense, record, and provide information about individual or aggregated punches, punch types, and/or punch combinations are possible and contemplated within the scope of the present disclosure.

Figure 3:
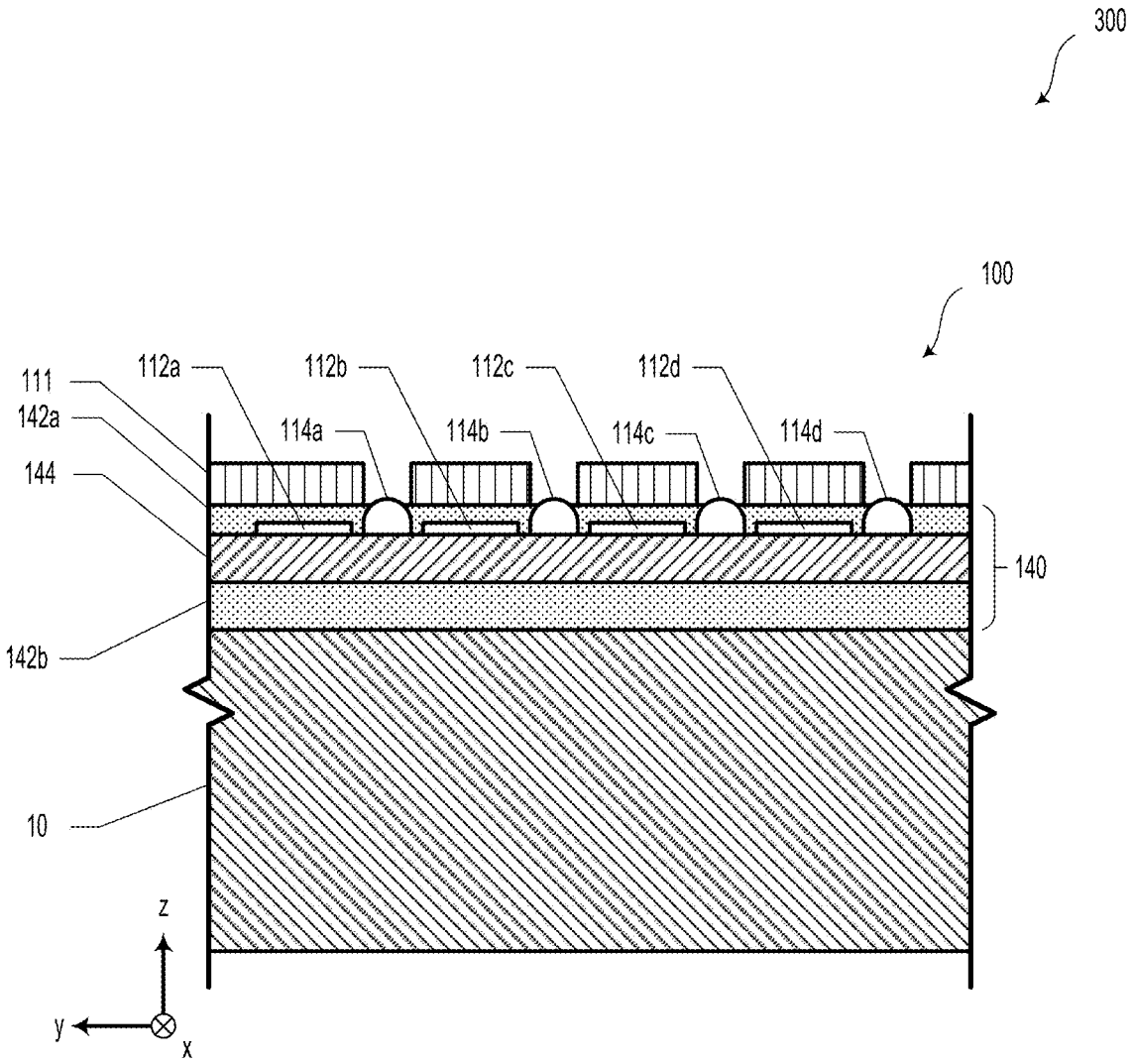
FIG. 3 illustrates a portion of the system of FIG. 1, according to an example embodiment.

FIG. 3 illustrates a portion 300 of the system 100 of FIG. 1, according to an example embodiment. Portion 300 could illustrate a cross-sectional view of several elements of system 100. For example, portion 300 indicates the outer surface 111 that may include openings configured to allow light emitted from the light-emitting devices 114*a*-114*d* to be visible to a user.

The outer surface 111 could be coupled to a multi-layer structure 140. In some embodiments, the multi-layer structure 140 could be a "sandwich" arrangement that includes a first impact-absorbing layer 142*a*, a device layer 144, and a second impact-absorbing layer 142*b*. It will be understood that other arrangements of layers and/or more or fewer layers are possible in the multi-layer structure 140. The multi-layer structure 140 could be attached to the punching bag 10 by way of cinch straps 116.

In some embodiments, a user's reaction time could be measured by indicating strike targets using the light-emitting devices 114 and measuring the reaction time between onset of light-emitting devices 114 and a strike on one or more force sensors 112.

In various embodiments, systems and devices described herein could provide training regimens to teach punch combinations and timing sequences by illuminating the light-emitting devices 114 according to predetermined training sequences.

In some examples, the camera 180 could be utilized to capture user workouts. Such information could be utilized to provide information about strike timing. For example, system 100 could allow a user to review each individual strike and view a video of the athlete's biomechanics for a given strike.

System 100 could additionally include a communication interface 130. The communication interface 130 could include a wired or wireless communication link between various elements of system 100. For example, the communication interface 130 could provide connectivity between the controller 150 and a graphical user interface 160, the camera 180, and a remote server 190.

By utilizing the communication interface 130, users may be able to upload strike data and workout videos to the remote server 190 for professional assessment (e.g., via an online coach/trainer). Additionally or alternatively, the communication interface 130 could provide one- or two-way communication to upload strike data and download relevant predetermined workout programs. In some embodiments, athletic performance results could be uploaded and compared with other athletes participating in the same workout or exercise. For example, characteristics of a user's strike data could be compared to strike data of remote users participating in the same workout in near-real time. Additionally or alternatively, a user's strike data could be compared to that of professional athletes (e.g., professional mixed martial arts fighters, professional boxers, professional football players, etc.)

In some embodiments, the remote server 190 could store historical user strike data to show training progress over time. In such scenarios, a user may be able to review visual graphs, charts, and/or other information relating to athletic performance over several workouts, several weeks, months, and/or years.

In various embodiments, the communication interface 130 could be configured to communicate with a mobile device (e.g., smartphone, tablet, laptop computer, or another type of mobile computing device). In such scenarios, some or all of the user interface interactions could be performed by way of a touchscreen, camera, and/or microphone of the mobile device. Additionally or alternatively, the display of the mobile device could provide graphical feedback of user performance and/or other statistical information about user activity.

III. Example Devices

Figure 4:
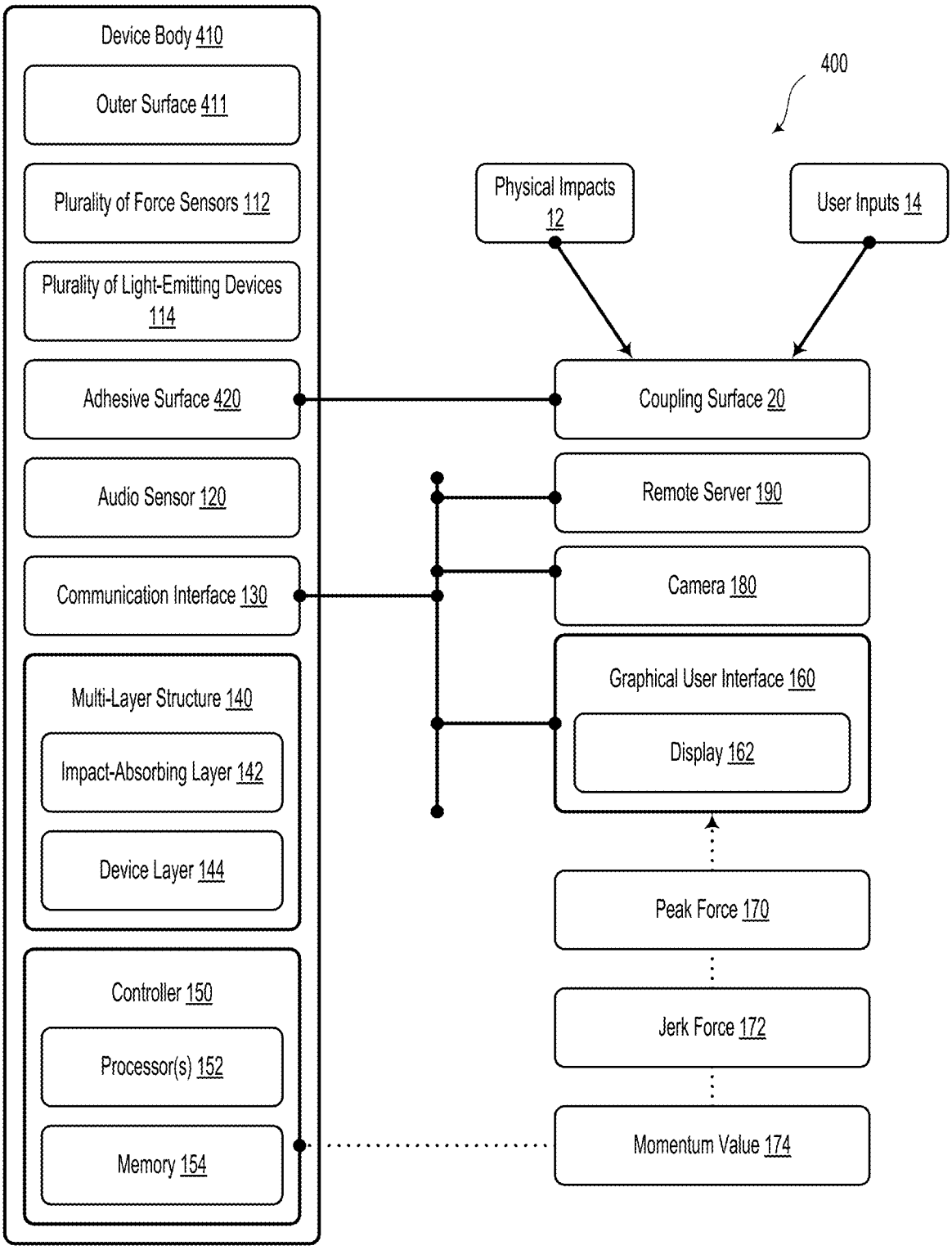
FIG. 4 illustrates a device, according to an example embodiment.

FIG. 4 illustrates a device 400, according to an example embodiment. The device 400 could include a peel-and-stick impact sensing device or another type of impact sensor that is releasably couplable to various surfaces, such as on athletic equipment. It will be understood that device 400 could include similar or identical elements as those of system 100 as described and illustrated in reference to FIG. 1.

In various embodiments, the device 400 includes a device body 410 configured to be removably coupled to a coupling surface 20. It will be understood that coupling surface 20 could encompass a variety of athletic equipment, such as tackling sleds, punching bags, shoulder pads, boxing glove, tennis racquets, or baseball/softball bats, among many other examples.

The device 400 also includes at least one force sensor 112 coupled to the device body 410. In such a scenario, the at least one force sensor 112 could be configured to detect physical impacts to the coupling surface 20.

In some embodiments, device 400 could include a circuit board (e.g., device layer 144) with an in-laid force sensor (e.g., force sensor 112) and ring of light-emitting devices 114 protected by rubber spacers. The circuit board could be covered by a ⅜" Shocktec gel wrap or another type of impact-absorbing material. Other impact-absorbing materials could include polymer and/or gel-based materials. Additionally or alternatively, such impact-absorbing materials could include highly-damped, visco-elastic solid materials.

The device 400 additionally includes a controller 150, which may include at least one processor 152 and a memory 154. The at least one processor 152 executes program instructions stored in the memory 154 so as to carry out operations. The operations include receiving, from the at least one force sensor 112, information indicative of one or more physical impacts 12. The operations also include determining, based on the received information, at least one of: a peak force 170, a jerk time 172, or a momentum value 174.

In some embodiments, device 400 may include a plurality of light-emitting devices 114 coupled to the device body 410. In such examples, the plurality of light-emitting devices 114 could be configured to indicate strike targets. In such scenarios, the operations may additionally include causing the one or more light-emitting devices of the plurality of light-emitting devices 114 to indicate strike targets (e.g., locations where a user may punch, kick, or knee the punching bag).

Furthermore, in some embodiments, the plurality of light-emitting devices 114 could be configured to indicate a plurality of user-selectable operating modes. Such user-selectable operating modes could include at least one of: a random operating mode, a workout mode, a proficiency-dependent mode, or an activity-specific mode. Other user-selectable operating modes are possible and contemplated. In such scenarios, the controller 150 could be configured to carry out operations such as causing one or more light-emitting devices of the plurality of light-emitting devices 114 to indicate the plurality of user-selectable operating modes.

In various embodiments, the operations could also include receiving, from the at least one force sensor 112, information indicative of a user input 14. The operations could also include determining, based on the received information, a desired operating mode.

In some example embodiments, the device 400 could include an audio sensor 120 (e.g., a microphone). In such scenarios, the operations could also include receiving, from the audio sensor 120, information indicative of a user input. Accordingly, the operations could additionally include the controller 150 determining, based on the received information, a desired operating mode. In other words, a user of device 400 could use voice commands to choose workout routines or otherwise control the operation of device 400. In such scenarios, a user (who may be wearing gloves) need not control the device with his/her fingers via a touchpad).

In various examples, at least a portion of the device body 410 could include an adhesive surface 420 configured to couple the device body 410 to the coupling surface 20.

It will be understood that the nature of device 400 could lend itself to force measurements in a variety of athletic performance and sporting scenarios. As an example, device 400 could be used as peel-and-stick sensors for use in five or seven person football sleds to synchronize multi-player motions of an offensive line or defensive line. As an example, a plurality of devices 400 could be applied to a five person football sled. The plurality of devices 400 could be synchronized by way of a common clock or based on a reference time. The reference time could be set based on an audio trigger (e.g., quarterback cadence, whistle, clap, loud yell, etc.). In such a scenario, a reaction time and/or physical impact information could be provided for each lineman when the "fire off the ball" to hit the football sled in response to hearing the audio trigger. As such, the devices 400 could help evaluate or train football linemen. Other applications involving synchronized or reaction-based physical strikes could be enabled by utilizing one or more devices 400.

In some embodiments, device 400 could be utilized to provide force metrics in contact sports that involve palm and hand strikes. In American football, Offensive and Defensive linemen use complex hand strikes to opponents' hands, arms, chest, and helmets to gain leverage over the opposing team on every play of a football game. The efficacy of these movements determine whether the offensive or defensive player gains an advantage and directly impacts the result of the play. If the defensive lineman has superior hand-fighting technique, it can result in sacks, tackles behind the line of scrimmage, or pass incompletions. If the offensive lineman has superior technique, the quarterback will have more time to complete a pass and running backs will have more success running the ball.

Conventional metrics previously used to analyze linemen are their combine times and drill performance (agility), bench press (strength), and 40 yard dash (speed). Device 400 may provide coaches and scouts a more granular and accurate metrics with which to judge athletic potential by measuring the impact force and reaction time of the athlete performing hand strikes and blocking drills on tackling dummies, bags, and sleds. Force measurements from device 400 can show, for example, that a 6'3" 300 lb lineman generates more force in their hand-strikes to a tackling sled than a 6'7" 330 lb lineman despite conventional metrics and the common conception that a larger/heavier player should hit harder. Device 400 could also be used to provide metrics to quantify technique and conditioning changes over time, provide benchmarks to inform return-to-play guidelines, and assess the efficacy of playing an injured player over their back-up in real-time.

Another factor that is crucial to linemen is their ability to react to the quarterback's snap count and hike of the football. This is true for both offense and defense. Offensive linemen must be able to react to changes in cadence when a quarterback tries to expose potential blitzing players, draw the defense offside, and in cases when the stadium noise is too loud to hear the snap count. In such scenarios, device 400 could include a speaker, which can play audio recordings of any quarterback snap count and measure the reaction time from snap count to hand strike. These audio recordings of snap counts can be queued up by a coach and changed in real time to simulate in-game scenarios.

In various embodiments, device 400 could provide a training device for football players particularly due to its capacity for group training. The multi-man Sled is a tackling sled with five to seven blocking positions. In such scenarios, device 400 could be attached to each position on the sled. In such scenarios, coaches will be able to measure the cumulative force of the entire offensive/defensive line and the individual forces produced by each linemen. Accordingly, device 400 could also measure the combined and individual reaction times to the snap counts by each player. This will create entirely new metrics to assess talent, athletic ability, and improvement over time in all offensive and defensive linemen at any level of football.

Figure 5:
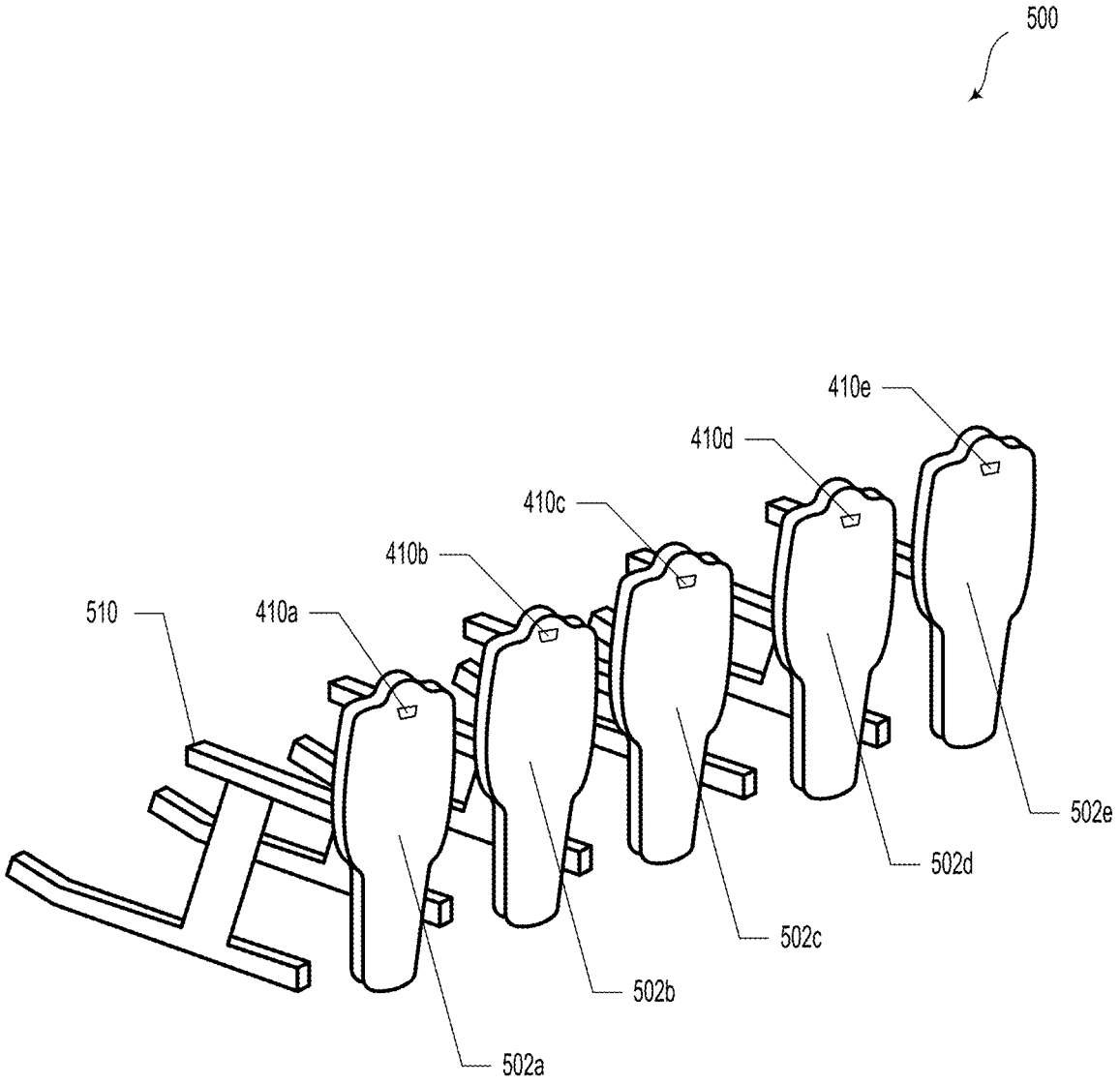
FIG. 5 illustrates an operating scenario involving the device of FIG. 4, according to an example embodiment.

FIG. 5 illustrates an operating scenario 500 involving the device 400 of FIG. 4, according to an example embodiment. Operating scenario 500 illustrates a tackling sled 510 with a plurality of tackling dummy impact surfaces 502*a*-502*e*. Each of the impact surfaces 502*a*-502*e* could provide a respective coupling surface 20 within the context of the device 400 as described and illustrated in reference to FIG. 4. That is, respective device bodies 410*a*-410*e* could be coupled to the impact surfaces 502*a*-502*e*.

Figure 6:
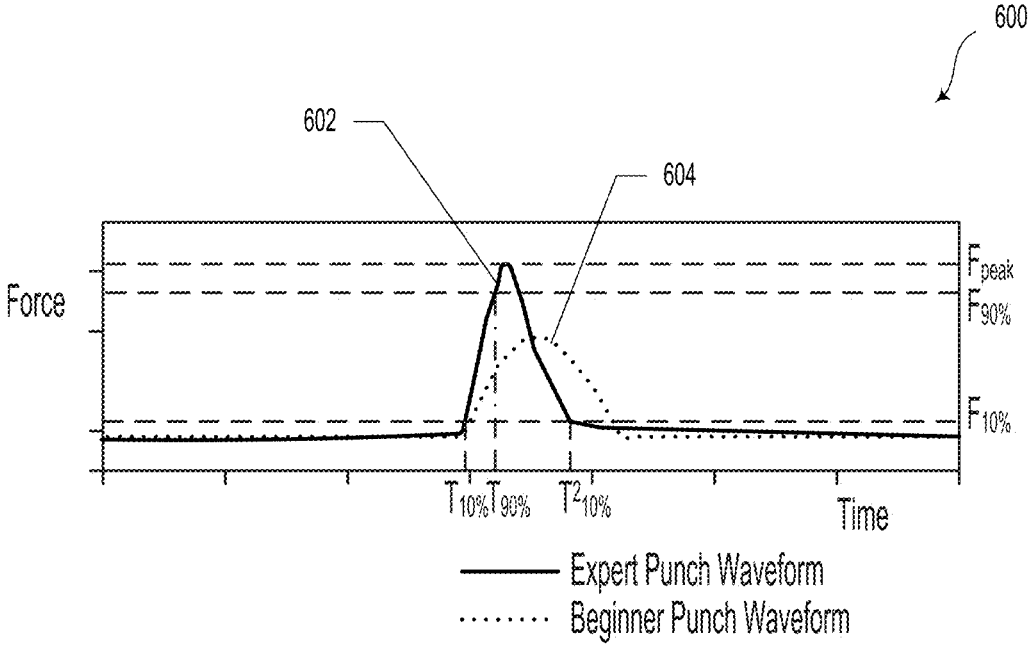
FIG. 6 illustrates force sensor waveforms, according to example embodiments.

FIG. 6 illustrates a signal versus time graph 600 that includes force sensor waveforms 602 and 604, according to example embodiments. As illustrated, the jerk, peak force, and shove (e.g., momentum) values could be determined based on the waveforms 602 and 604. For example, with respect to waveform 602, the jerk could be taken as the maximum time derivative of the force versus time data. The peak force could be the maximum value of the force versus time date, and the shove or momentum value could be the integral of the force versus time data during the duration of the strike. These values can be approximated based on the illustrated equations. It will be understood that other ways to calculate these values are possible and contemplated.

As an example, waveform 602 could include an example of a punch executed by an expert, whereas waveform 604 could be an example of a punch executed by a beginner. As illustrated, waveform 602 could include a higher peak force 170, shorter transient (e.g., shorter jerk time 172), and higher change in momentum (e.g., momentum value 174) as compared to waveform 604. It will be understood that punches, kicks, and/or other physical strikes could provide different waveform shapes, amplitudes, and other characteristics.

IV. Example Methods

Figure 7:
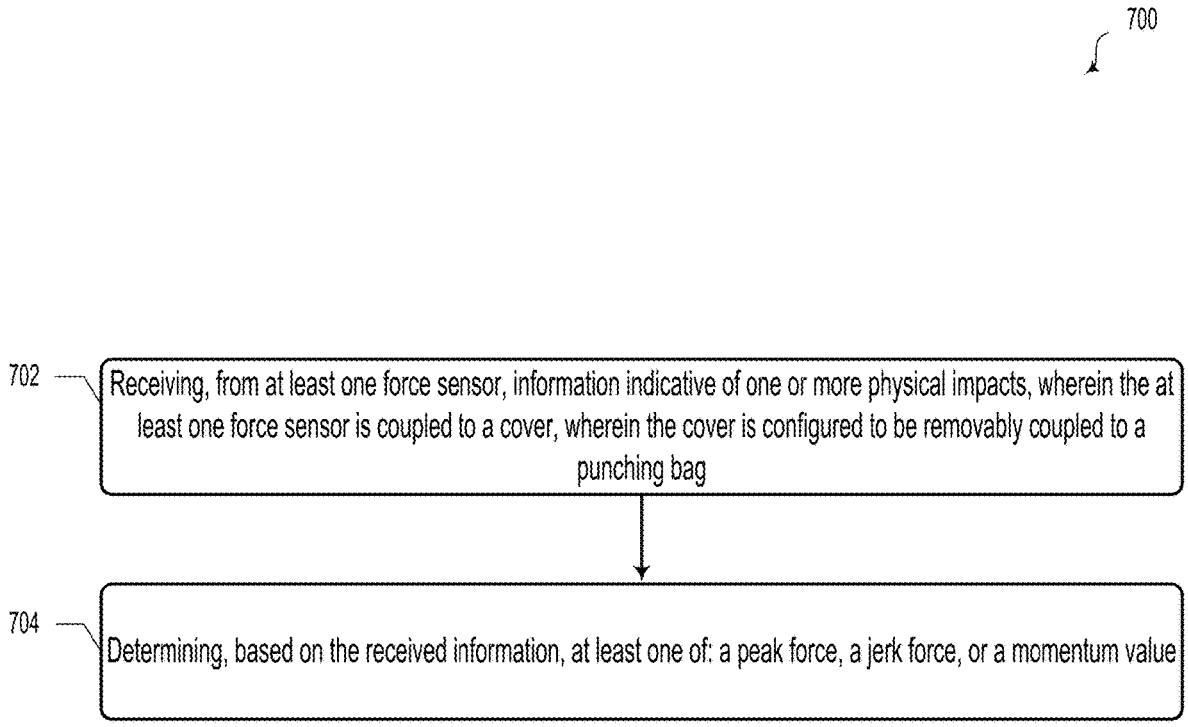
FIG. 7 illustrates a method, according to an example embodiment.

FIG. 7 illustrates a method 700, according to an example embodiment. It will be understood that the method 700 may include fewer or more steps or blocks than those expressly illustrated or otherwise disclosed herein. Furthermore, respective steps or blocks of method 700 may be performed in any order and each step or block may be performed one or more times. In some embodiments, some or all of the blocks or steps of method 700 may be carried out by an impact measuring systems (e.g., system 100) or a peel-and-stick force sensing device (e.g., device 400). It will be understood that other scenarios are possible and contemplated within the context of the present disclosure.

Block 702 includes receiving, from at least one force sensor (e.g., force sensors 112), information indicative of one or more physical impacts (e.g., physical impact 12). The at least one force sensor is coupled to a cover (e.g., cover 110). In such scenarios, the cover could be configured to be removably coupled to a punching bag (e.g., punching bag 10).

Block 704 includes determining, based on the received information, at least one of: a peak force (e.g., peak force 170), a jerk time (e.g., jerk time 172), or a momentum value (e.g., momentum value 174).

In example embodiments, the method 700 could include causing one or more light-emitting devices of a plurality of light-emitting devices (e.g., light-emitting devices 114) coupled to the cover to indicate one or more strike targets on the punching bag.

Additionally or alternatively, the method 700 could include causing one or more light-emitting devices of the plurality of light-emitting devices coupled to the cover to indicate a plurality of user-selectable operating modes. For example, the user-selectable operating modes could include one or more of: a random operating mode, a workout mode, a proficiency-dependent mode, or an activity-specific mode. The random operating mode could require the participant to strike at randomly-selected strike targets indicated by the plurality of light-emitting devices. The workout mode may require the participant to strike a predetermined number and/or sequence of strike targets. The proficiency-dependent mode could provide a predetermined number and/or sequence of strike targets based on a desired proficiency type (e.g., punch/kick type) or proficiency level (e.g., beginner/intermediate/expert/professional/elite).

In some embodiments, a user could strike various strike targets to select the user-selectable operating mode. For example, method 700 could include receiving, from at least one force sensor, information indicative of a user input. In such scenarios, method 700 could also include determining, based on the received information, a desired operating mode.

Figure 8:
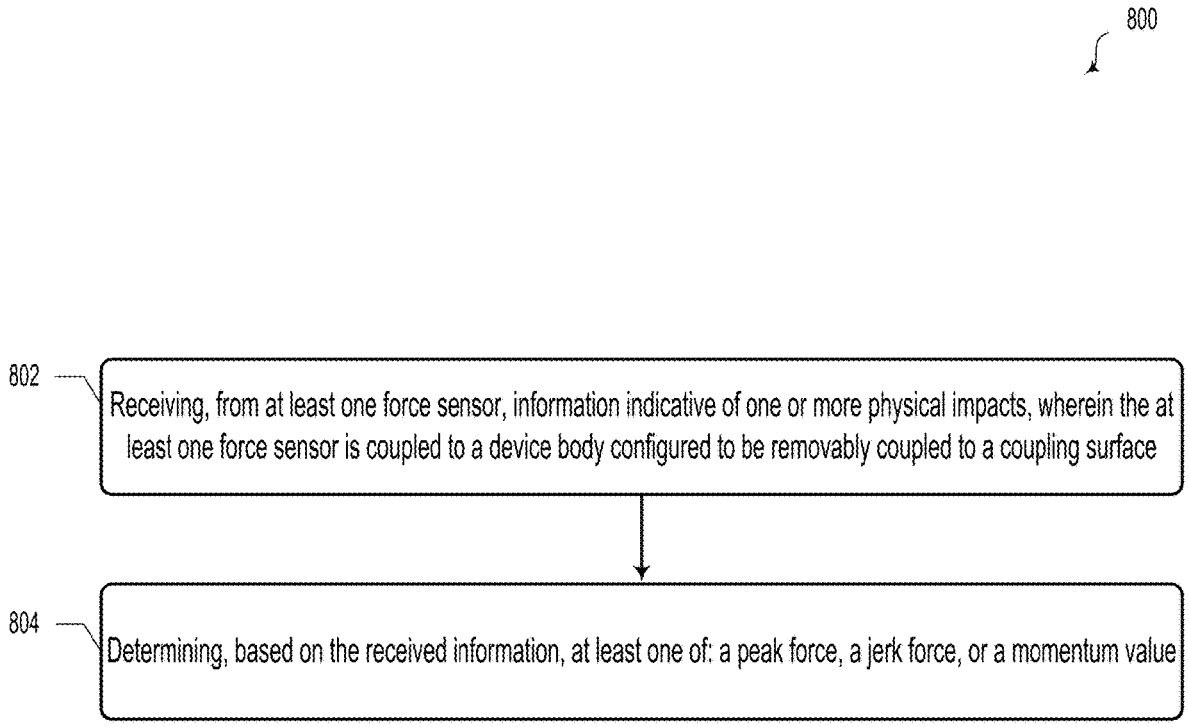
FIG. 8 illustrates a method, according to an example embodiment.

FIG. 8 illustrates a method 800, according to an example embodiment. Method 800 may include fewer or more steps or blocks than those expressly illustrated or otherwise disclosed herein. Furthermore, respective steps or blocks of method 800 may be performed in any order and each step or block may be performed one or more times. In some embodiments, some or all of the blocks or steps of method 800 may be carried out by an impact measuring systems (e.g., system 100) or a peel-and-stick force sensing device (e.g., device 400). It will be understood that other scenarios are possible and contemplated within the context of the present disclosure.

Block 802 includes receiving, from at least one force sensor (e.g., force sensor 112), information indicative of one or more physical impacts (e.g., physical impacts 12). The at least one force sensor is coupled to a device body (e.g., device body 410), which could be configured to be removably coupled to a coupling surface (e.g., coupling surface 20).

Block 804 may include determining, based on the received information, at least one of: a peak force (e.g., peak force 170), a jerk time (e.g., jerk time 172), or a momentum value (e.g., momentum value 174).

Method 800 may additionally include causing one or more light-emitting devices of a plurality of light-emitting devices (e.g., light-emitting devices 114) coupled to the device body to indicate one or more strike targets.

In some example embodiments, method 800 could also include causing one or more light-emitting devices of the plurality of light-emitting devices coupled to the device body to indicate a plurality of user-selectable operating modes. As an example, the user-selectable operating modes could include at least one of: a random operating mode, a workout mode, a proficiency-dependent mode, or an activity-specific mode, as described herein.

In various embodiments, method 800 could include receiving, from the at least one force sensor, information indicative of a user input (e.g., user input 14). In such scenarios, the method 800 could also include determining, based on the received information, a desired operating mode.

V. Example Graphical User Interfaces

Figure 9:
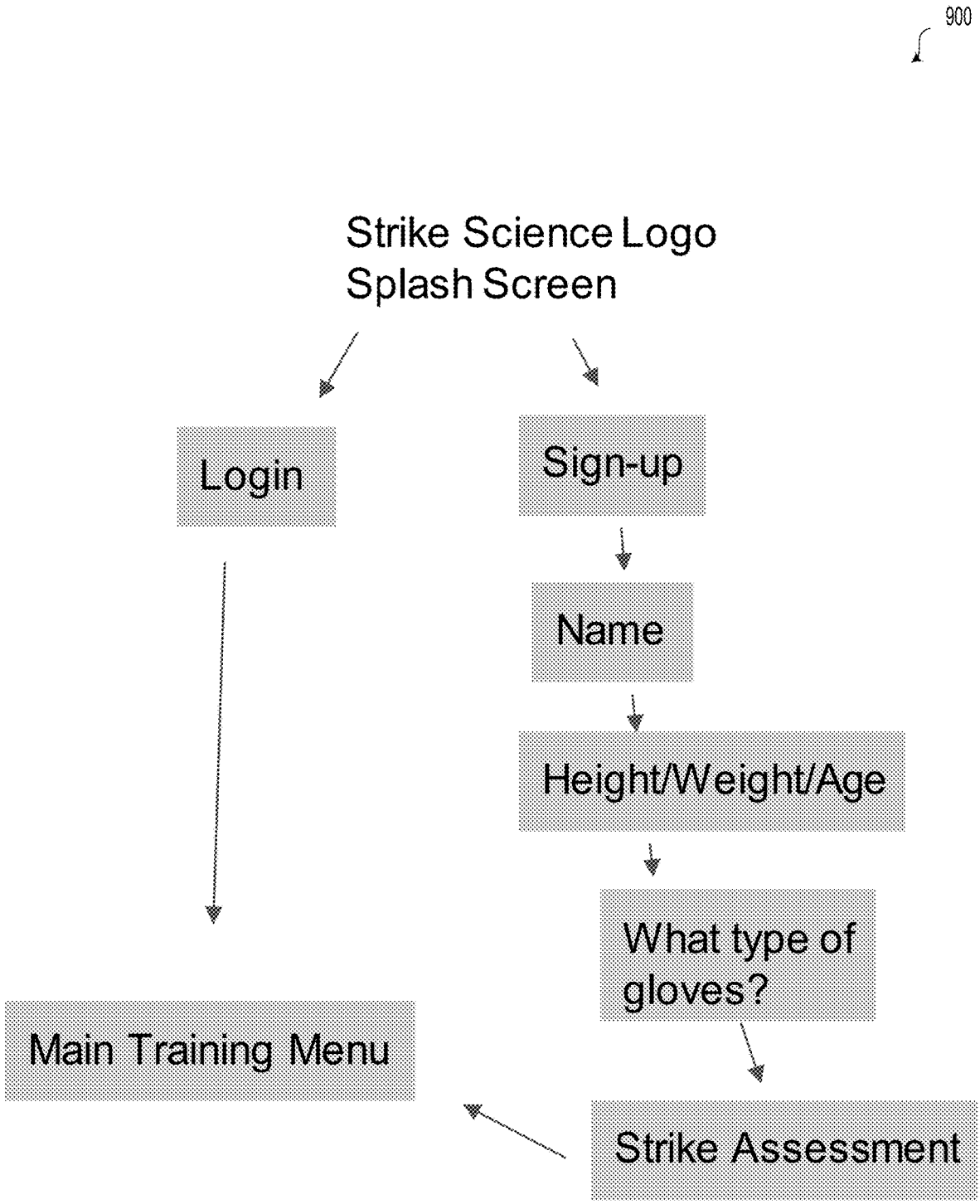
FIG. 9 illustrates a login/setup graphical user interface flow diagram, according to an example embodiment.

FIG. 9 illustrates a login/setup graphical user interface flow diagram 900, according to an example embodiment. Flow diagram 900 could represent, for example, a sequence of possible user interface screens. In some embodiments, the graphical user interface could relate to a "Strike Science" application, which could be executable on a mobile device (e.g., a smartphone, tablet, smartwatch, or another type of computing device). Upon execution, the application could display a splash screen, which may include a logo. From the splash screen, new users could sign-up for a new user account by entering their name, height/weight/age, glove type (e.g., bag gloves, sparring glove, etc.), and/or other user information. Example inputs could include: Mandatory Inputs: Name, Age, Height/Weight, Stance. Optional inputs may include: Size of Gloves, Experience Level/Discipline. Example—Jon B, 34, 5'11,180 lbs, Southpaw Optional—16 oz Boxing Gloves, Muay Thai/Boxing Expert level >15 years experience. In such scenarios, the strike assessment may be conducted so as to determine a baseline for a given user's punch force and other fitness characteristics. In some embodiments, returning users could enter a username and password to log into their account.

The user account setup will form the basis for an online account database that is constantly aggregating data collected from all network-connected systems 100.

Figure 10:
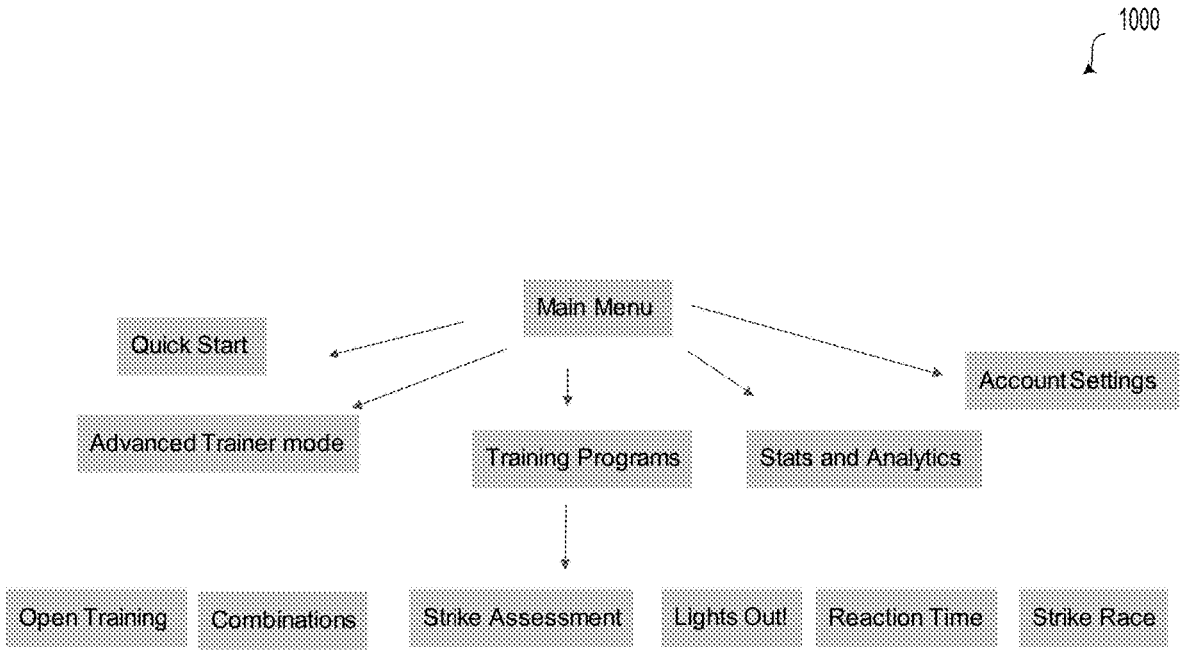
FIG. 10 illustrates a main menu graphical user interface flow diagram, according to an example embodiment.

Upon either logging into a new or returning account, the graphical user interface could display a main training menu. FIG. 10 illustrates a main menu graphical user interface flow diagram 1000, according to an example embodiment. The main menu could offer a plurality of options for users to select. For example, a quick start mode could launch a predetermined workout mode of operation based on the user's identity, physical characteristics, and/or prior workout history. The main menu could also offer links to an advanced trainer mode, various training programs, statistics/analytics, and/or account settings.

The plurality of training programs could include, for example, an open training mode, combination training mode, strike assessment mode, lights out mode, reaction time mode, and/or strike race mode. It will be understood that other types of training programs are possible and contemplated within the scope of the present disclosure. For example, the training programs could include other types of game or competitive modes. Such game or competitive modes could provide a way for users to compare their athletic performance to other athletes' performances.

The strike assessment mode could include illuminating the light-emitting devices 114 so that the user hits each strike target with a punch 5 times, which could provide a baseline measurement and initial user statistics to form a user profile in the online database. This baseline could be referenced to show a user's improvement/regression over time using the system 100.

As multiple users use the system 100 (and other network-connected systems 100), their punch data and workout information could be collected and aggregated. The data points could provide for instantaneous comparison to similar/prior users, as well as form the basis for online simultaneous group class statistics. For example, the graphical user interface could display "Your right hook is within the 95th percentile of all men in their 30s that weigh between 180-200 lbs." "Among experts with >15 years of experience, your right hook is in the 85th percentile in total force, and 92th percentile in jerk time." Such statistical analyses from the data collected could be provided in real time and could be used to inform previously unanswerable questions by the user or utilized by the manufacturer of system 100 to design more effective or customized workouts.

Figure 11:
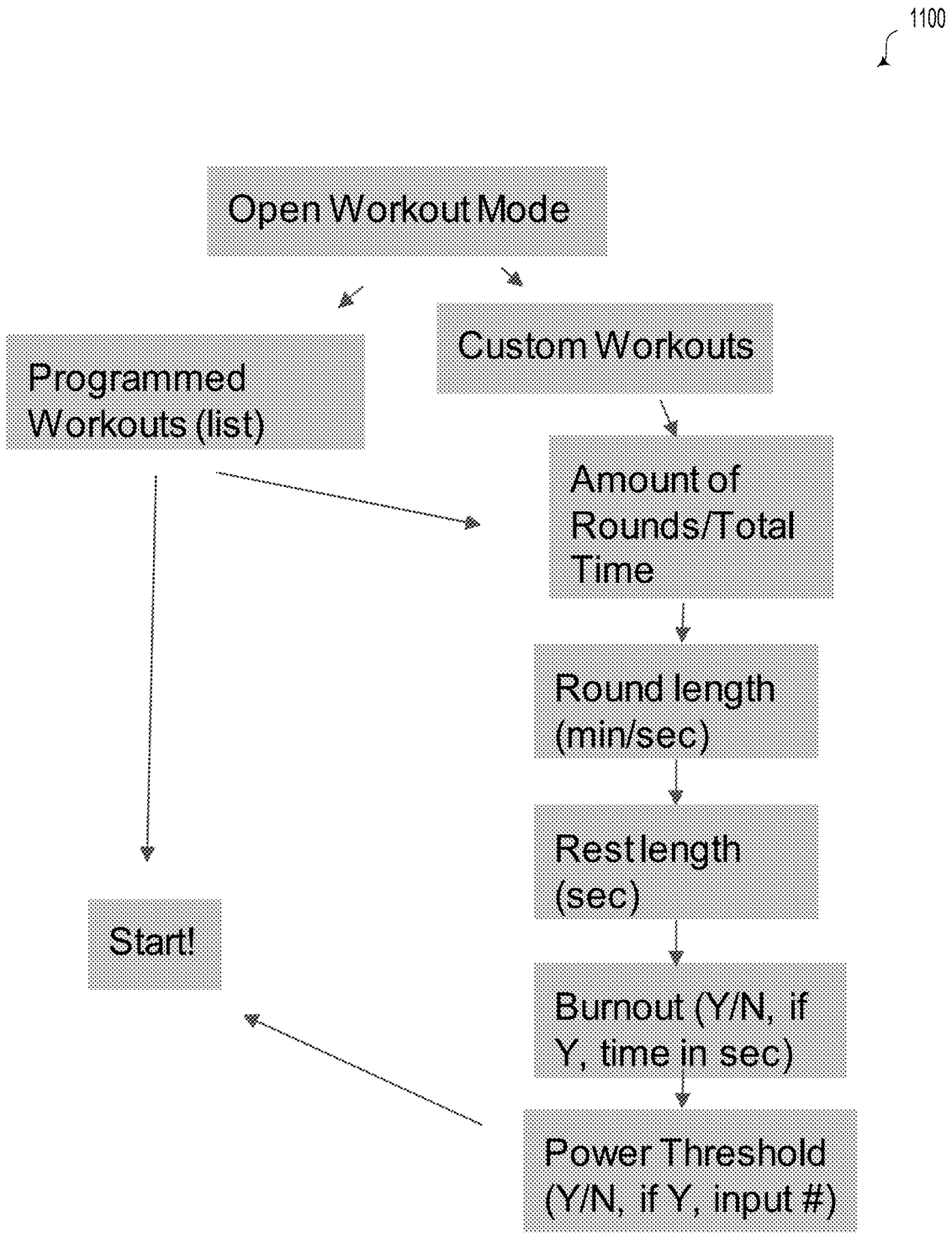
FIG. 11 illustrates an open workout mode graphical user interface flow diagram, according to an example embodiment.

FIG. 11 illustrates an open workout mode graphical user interface flow diagram 1100, according to an example embodiment. In such scenarios, the graphical user interface could provide a way for users to customize their workouts by selecting desired custom workouts and/or various workout elements (e.g., amount of rounds, round length, rest length, burnout time, and/or power threshold).

Figure 12A:
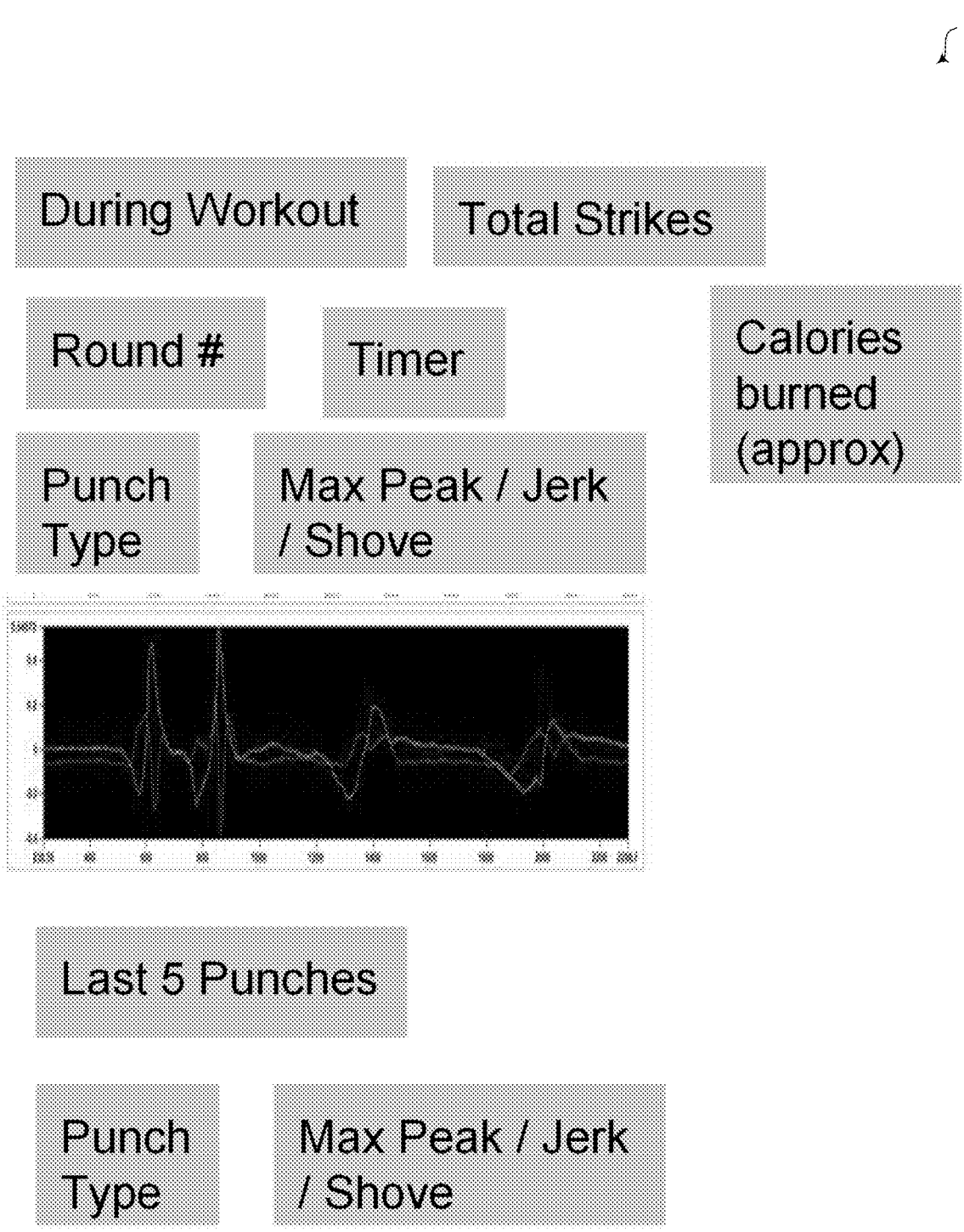
FIG. 12A illustrates a graphical user interface, according to an example embodiment.

FIG. 12A illustrates a graphical user interface 1200, according to an example embodiment. Graphical user interface 1200 could represent a standard screen for normal workouts. In such a scenario, the standard screen could include information about a round number, timer, total number of strikes, calories burned, pulse rate, punch type, maximum force/rise time/transient, and/or information about previous punches (e.g., the last five punches).

Figure 12B:
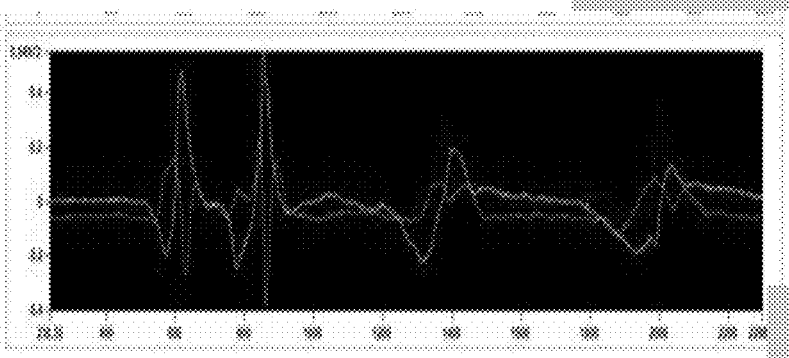
FIG. 12B illustrates a graphical user interface, according to an example embodiment.

FIG. 12B illustrates a graphical user interface 1220, according to an example embodiment. Graphical user interface 1220 could represent graphical user interface 1200 with example data.

The various combination punching game modes could include a specific order that lights are turned on indicate a specific combination (A jab-cross-left hook orthodox combination based on the above target example will flash Target 2, Target 3, Target 1).

Figure 13:
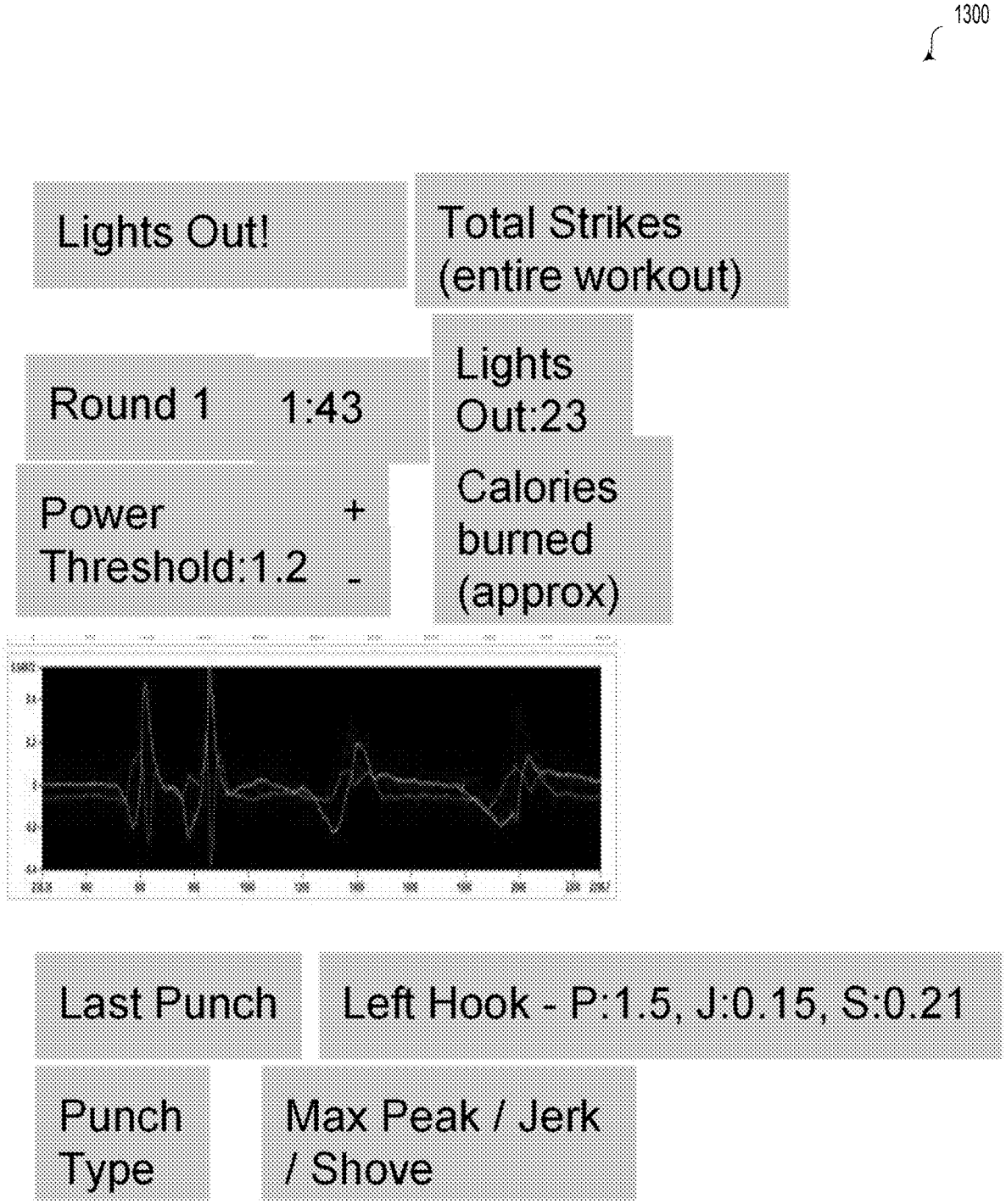
FIG. 13 illustrates a lights out mode graphical user interface, according to an example embodiment.

FIG. 13 illustrates a lights out mode graphical user interface 1300, according to an example embodiment. The lights out mode could include a succession of lights that stay illuminated until a corresponding strike target is punched by the user. As such, the lights out mode could provide a way to quantify reaction time, reach, and/or peripheral vision. In other contexts, the lights out mode could be similar to or equivalent to a "whack a mole" type game.

Figure 14:
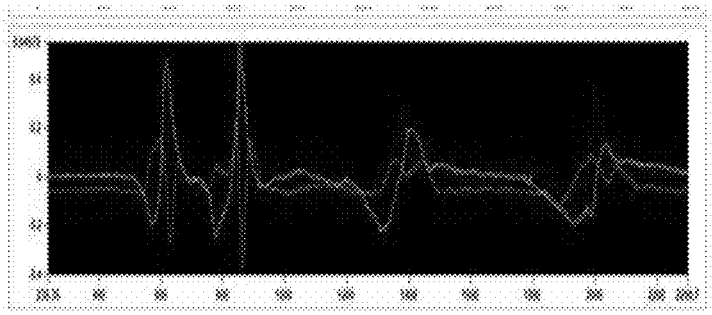
FIG. 14 illustrates a strike race mode graphical user interface, according to an example embodiment.

FIG. 14 illustrates a strike race mode graphical user interface 1400, according to an example embodiment. Strike race mode could include the user punching a predetermined order of strike targets (e.g., single punches and/or punch combinations). The strike race mode could provide a way for users to compare their punch combination performance to that of other athletes or a user's prior performance.

Figure 15:
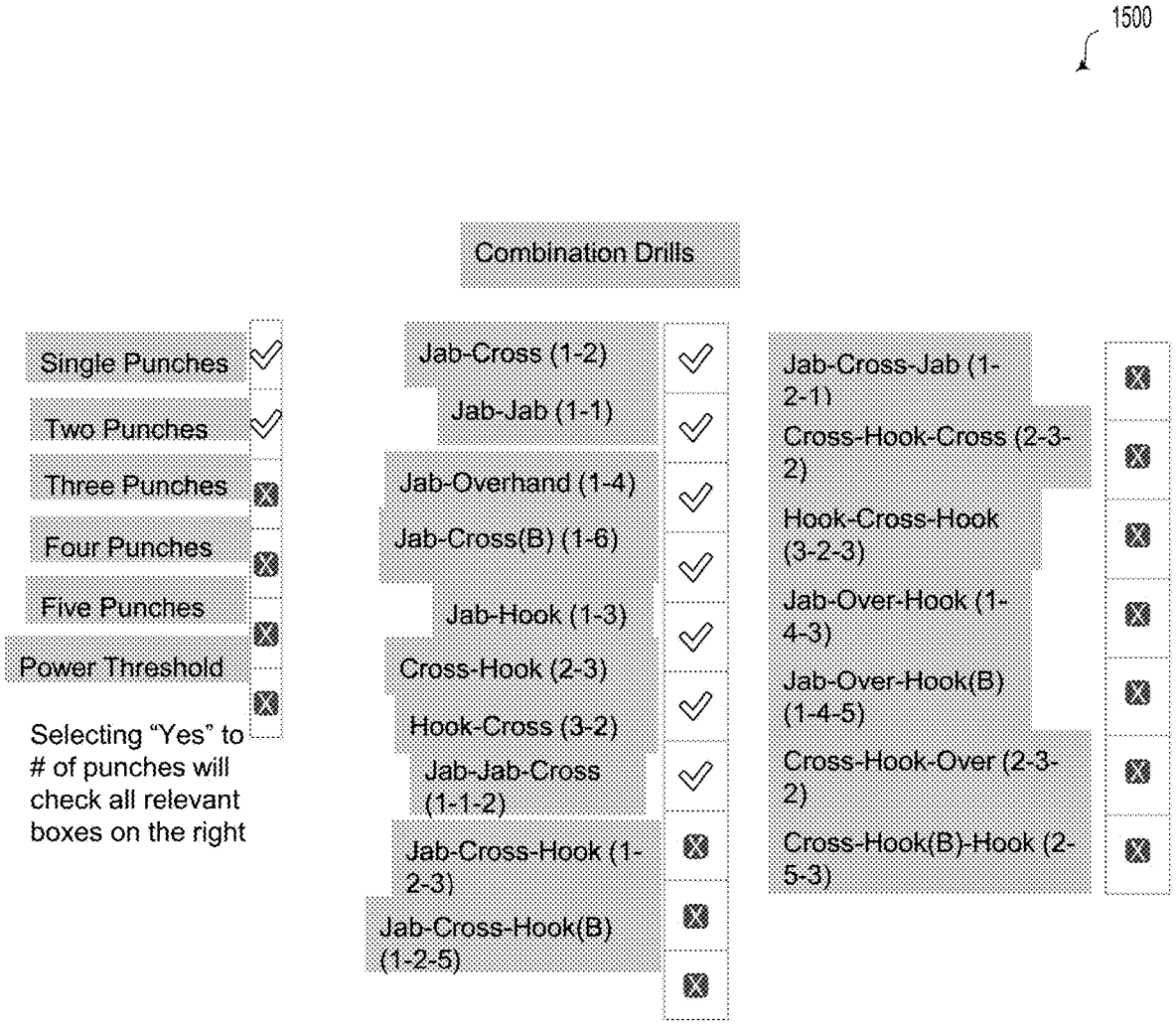
FIG. 15 illustrates a combination drill graphical user interface, according to an example embodiment.

FIG. 15 illustrates a combination drill graphical user interface 1500, according to an example embodiment. The combination drill graphical user interface 1500 could include a way for users to select various drills or activities related to training or practicing punch combinations. In an example embodiment, a user may select combination criteria in the left-most column. Upon user input in the left-most column, various combinations may auto-fill in the middle and right-most columns, based on the selected parameters. In some embodiments, other types of combinations, including 4+ punch combinations are possible and contemplated.

FIG. 16 illustrates a combination builder graphical user interface 1600, according to an example embodiment. The combination builder could include a left-most column that includes the first punch thrown and the right-most column could include potential follow-up punches that could be thrown in a smooth combination. This combination builder table can be used to build any length of combinations that a user can add to their combination workout library. The (Adv) indicates an advanced punching combination. Basic combinations like a Jab-Cross (1-2) work cooperatively, the pull-back after the jab lands helps generate torque for the right hand. The mechanics of a jab followed by a hook is considered advanced because it involves punches from the same arm consecutively so the kinetic energy doesn't transfer like a 1-2 would and the reset between punches may largely determine the combination's effectiveness.

Figure 17:
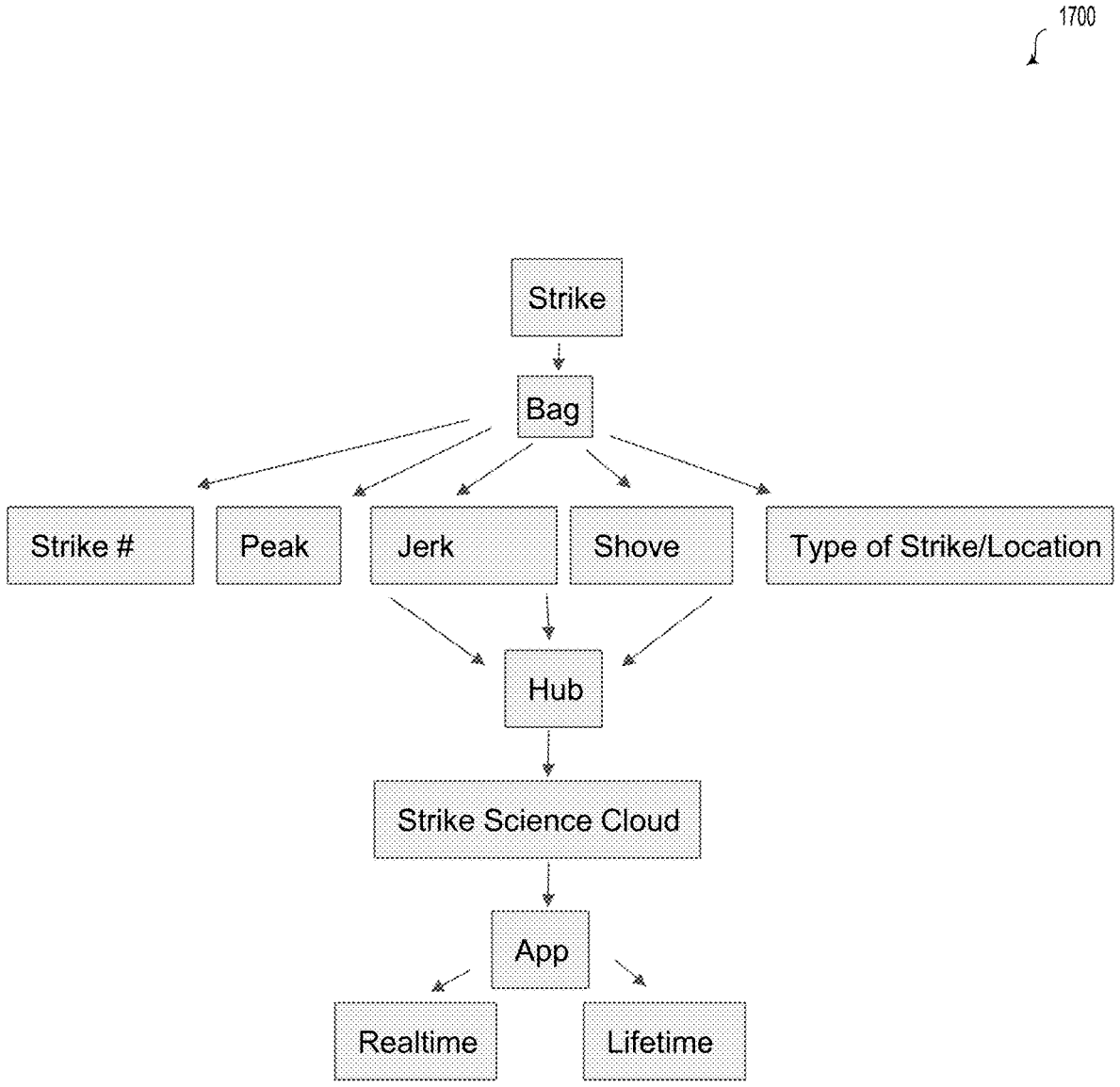
FIG. 17 illustrates a flow diagram, according to an example embodiment.

FIG. 17 illustrates a flow diagram 1700, according to an example embodiment. Flow diagram 1700 illustrates a possible data flow from a punch landing to a display on the application. In such a scenario, upon a punch striking the bag, one or more force sensors 112 could detect various aspects of the punch, including the force, rise time, transient time, type of strike and/or location, as well as the strike number. The signals and corresponding information detected by the force sensors 112 could be transmitted via a wired or wireless communication link 130 to hub. Additionally or alternatively, the information could be translated to a network server, such as a cloud server. In some embodiments, the cloud server could host a strike science cloud computing service and/or file server. The strike science cloud computing service and/or file server could be configured to aggregate and/or analyze the information provided by the force sensors 112. Aggregated and/or analyzed data could be provide to the application by the strike science cloud computing service and/or file server, and such data could be displayed in real-time or in a historical aggregated form by way of a display on the mobile computing device.

Figure 18:
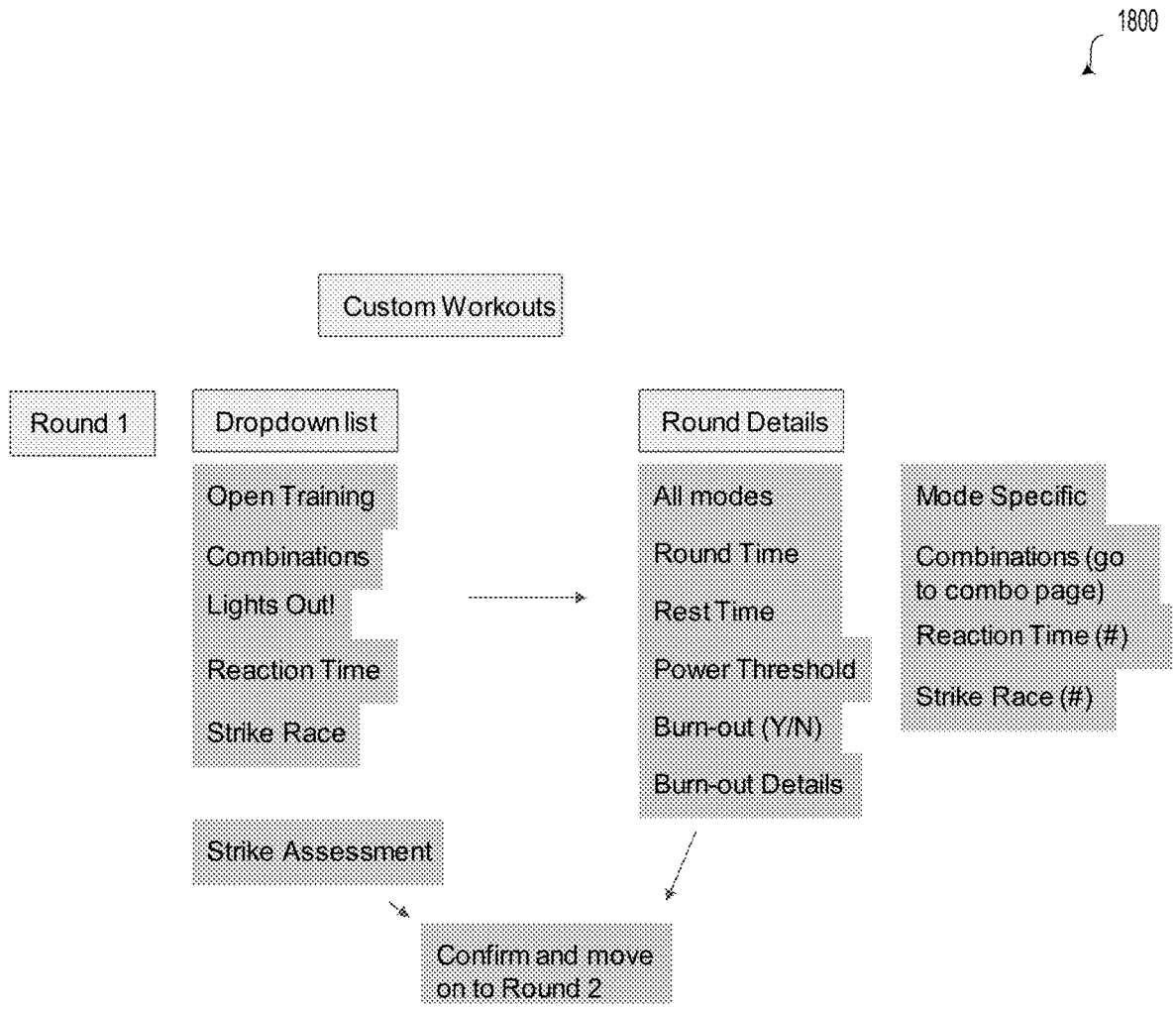
FIG. 18 illustrates a custom workout graphical user interface, according to an example embodiment.

FIG. 18 illustrates a custom workout graphical user interface 1800, according to an example embodiment. In some embodiments, the custom workout graphical user interface 1800 could provide a way for users or trainers to create their own workout programs.

FIG. 19 illustrates a subscription model graphical user interface 1900, according to an example embodiment. In some embodiments, the system 100 and/or graphical user interface could provide differing functionality based on a subscription level of the user.

As illustrated in FIG. 19, in some subscription levels, punches and overall athletic performance could be scored using a "Punchscore system." As described herein, the Punchscore system could be based on characteristics of a single punch or a punch combination. The Punchscore system could be used to show measurable improvements to technique in real-time. After altering a student's footwork or arm position, the user or trainer could receive near-instant feedback from the graphical user interface indicating whether the change in their technique helped improve their power/speed/range etc.

In some embodiments, the graphical user interface could provide analytical information. Such examples of analytics could include:

Displaying the men's weight class that has the highest ratio of power/lowest level of jerk.

Displaying who has better reaction time—boxing experts or karate experts?

Displaying who hits harder per capita—women in Kentucky or California?

One potential issue with determining the type of punch is the difference in stance (lefty vs righty—southpaw vs orthodox). For a southpaw user, the combinations all have to be reversed:

Jab Cross Hook (Coaches call this a 1-2-3 combination)

Orthodox—Left Jab (Target 2), Right Straight (Target 3), Left Hook (Target 1)

Southpaw—Right Jab (Target 3), Left Straight (Target 2), Right Hook (Target 4)

A solution to this could be provided when the user inputs their profile information (name, age, height, weight, stance—southpaw/orthodox). When a user selects southpaw as their preference, all workouts will flip the sensors and light routines to indicate proper combinations for their fighting stance.

VI. Example Integrated Force Sensor and Led Array

Figure 20:
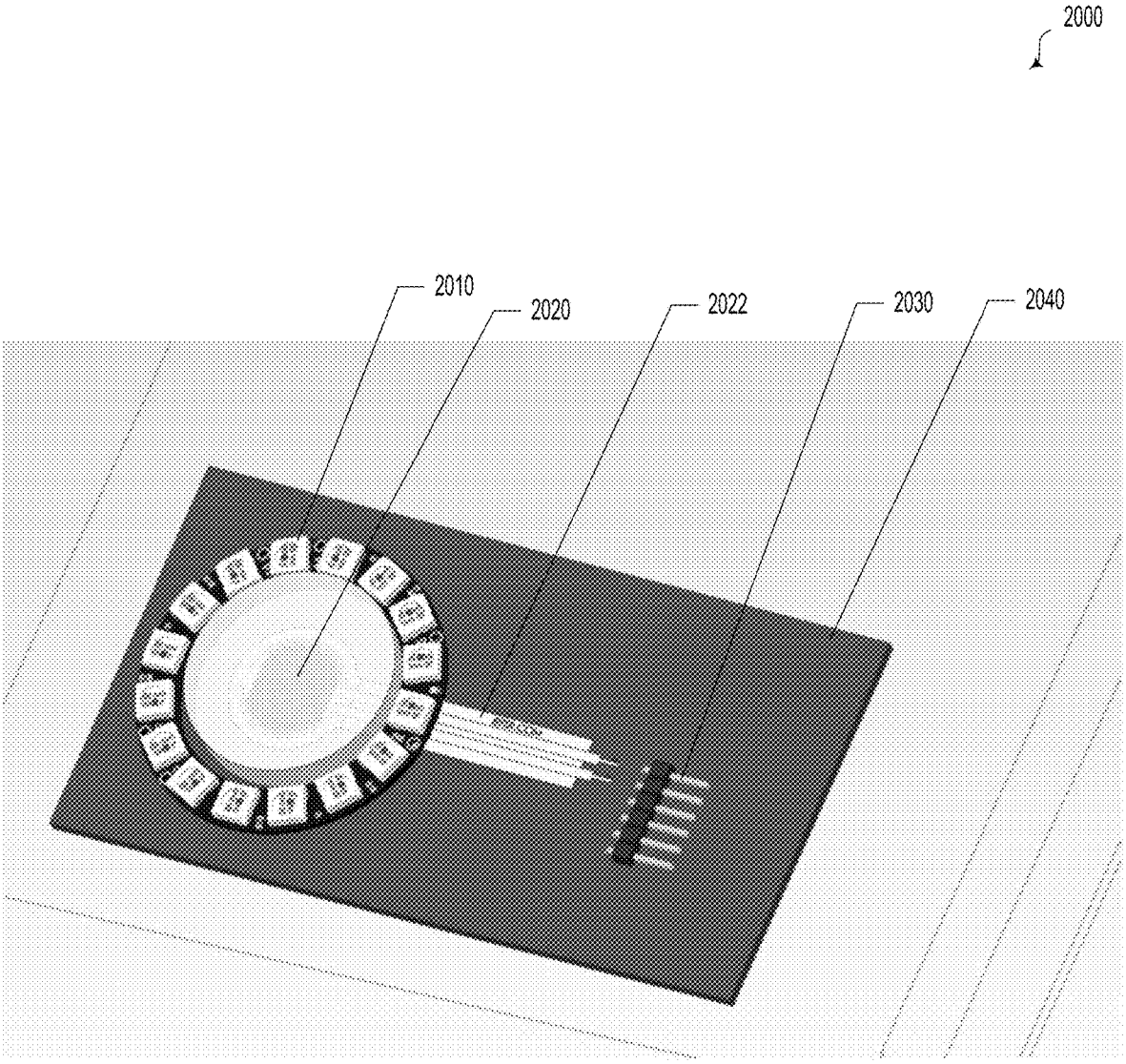
FIG. 20 illustrates an integrated force sensor and LED array, according to an example embodiment.

FIG. 20 illustrates an integrated force sensor and LED array 2000, according to an example embodiment. The integrated force sensor and LED array 2000 could include a programmable LED array 2010, a force transfer pad 2020, a force sensor 2022, and an electrical connector 2030. Such elements could be coupled to and/or mounted on a printed circuit board 2040. Other substrates are possible, including flexible (e.g., polymer-based) substrates.

The LED array 2010 could include a plurality of light-emitting devices 114, as illustrated and described in reference to FIG. 1. In an example embodiment, the LED array 2010 could include an Adafruit Neopixel Ring 16×LED 5050 RGB-programmable LED array. In such scenarios, each LED's color and intensity could be individually programmable by interfacing to a microprocessor through the electrical connector 2030.

When an athlete/user strikes the punching bag at the force transfer location and the force transfer pad 2020 transfers the force of the punch to the force sensor 2022. The force transfer pad 2020 may be configured to be thicker than the elements of the LED array 2010, which may help protect the LED array 2010. In other words, the force of the strike may be transferred to the transfer pad 2020 and not to the LED array 2010 because the LED array 2010 is recessed. In some embodiments, the force sensor 2022 could be communicatively coupled to a controller (e.g., controller 150) via a wired or wireless communication interface. As described elsewhere herein, the force sensor 2022 could provide a voltage or current signal indicative of the force transient signal from a punch or strike.

In various embodiments, the LED array 2010 could be programmed to change the number of pixels illuminated, the color of the pixels, and the overall intensities of the pixels in response to characteristics of the strike. For example, the number of LEDs lit could be proportional to the strike peak force, the duration proportional to the strike jerk, and/or the color chosen to indicate the magnitude of the strike shove. It will be understood that other ways to utilize the LED array 2010 to provide a visual indication of the strike characteristics are possible and contemplated.

VII. Example Lateral Force Transducer Systems

Example systems and methods described herein could additionally or alternatively incorporate the use of a lateral force transducer system. For example, in various embodiments, an athlete/user could stand on a lateral force transducer system while striking system 100. In such scenarios, the combination of lateral force information and strike force information may provide a more complete analysis of an athlete's form, athleticism, strike power, etc. Furthermore, since strike force is generated, at least in part, from the user's stance, leg extension, and by utilizing a lateral push from the ground surface, lateral force information could be useful in suggesting areas of improvement to deliver a more powerful or efficient strike.

Figure 21:
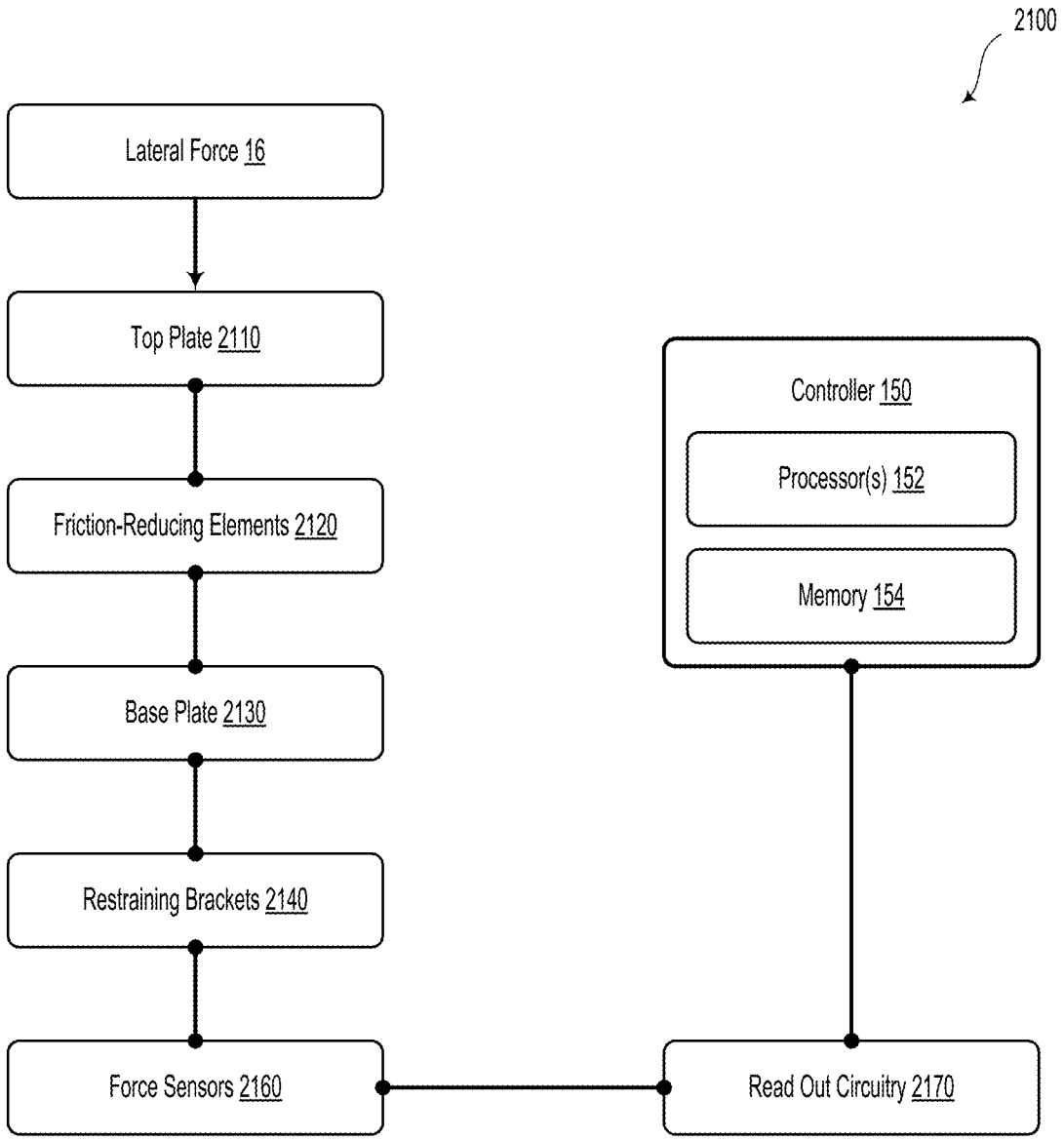
FIG. 21 illustrates a lateral force transducer system, according to an example embodiment.

FIG. 21 illustrates a lateral force transducer system 2100, according to an example embodiment. The lateral force transducer system 2100 includes a base plate 2130 and a top plate 2110 slidably coupled to the base plate 2130.

In some embodiments, the lateral force transducer system 2100 may also include a plurality of friction-reducing elements 2120 disposed between the base plate 2130 and the top plate 2110. In various embodiments, the friction-reducing elements 2120 could include at least one of: a ball bearing, a roller bearing, a fluid bearing, or skate wheels. In such scenarios, at least 64 friction-reducing elements 2120 could be disposed in a planar array between the base plate 2130 and the top plate 2110. It will be understood that other devices and/or mechanisms to provide a surface that moves laterally without friction are possible and contemplated.

The lateral force transducer system 2100 also includes at least two restraining brackets 2140 disposed proximate to opposite sides of the base plate 2130. In such scenarios, the restraining brackets 2140 are configured to restrict lateral movement of the top plate 2110 with respect to the base plate 2130.

The lateral force transducer system 2100 additionally includes a force sensor 2160 coupled to each restraining bracket 2140. Each force sensor 2160 is configured to measure a lateral force 16 applied to the top plate 2110 and transferred to a given restraining bracket 2140.

The lateral force transducer system 2100 also includes read out circuitry 2170 configured to provide information indicative of the amplitude of the lateral force 16 and a direction of the lateral force 16.

In some embodiments, the lateral force transducer system 2100 may additionally be communicatively coupled to a controller (e.g., controller 150) having at least one processor (e.g., processor 152) and a memory (e.g., memory 154). In some embodiments, the processor can execute program instructions stored in the memory so as to carry out operations.

The operations include receiving, from the read out circuitry 2170, information indicative of the lateral force 16 applied to the top plate 2110.

The operations may additionally include determining, based on the received information, an amplitude of the lateral force 16.

The operations may additionally include determining, based on the received information, a direction of the lateral force 16.

In some embodiments, the lateral force transducer system 2100 may include a base plate 2130 with four sides. In such scenarios, the at least two restraining brackets 2140 could include four total restraining brackets. In those cases, the restraining brackets 2140 could be disposed proximate to each side of the base plate 2130 (e.g., along the North, South, East, West sides of the base plate 2130).

In some embodiments, the direction of the lateral force 16 could include a force vector parallel to the base plate 2130.

In some embodiments, the top plate 2110 could include a plurality of bearing tracks configured to slidably interact with the friction-reducing elements 2120.

Figure 22:
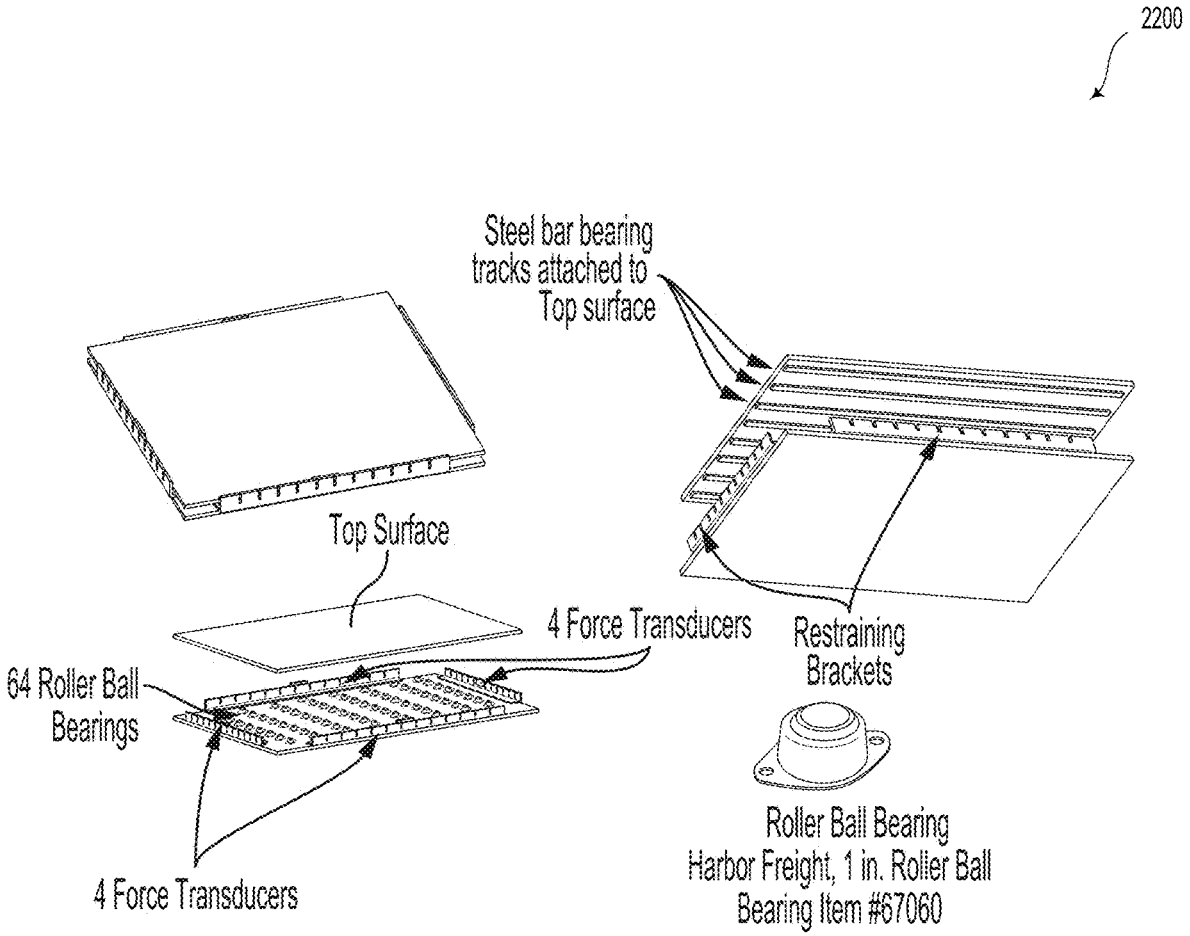
FIG. 22 illustrates a two-dimensional lateral force transducer system, according to an example embodiment.

FIG. 22 illustrates a two-dimensional lateral force transducer system 2200, according to an example embodiment. The two-dimensional lateral force transducer system 2200 is a size-scalable force sensing platform designed to measure horizontal forces during kinesthetic movement. The two-dimensional lateral force transducer system 2200 could be formed by two 4'×4' ¾" plywood boards, sixty four 1" ball-bearing rollers, eight 46"×1"×0.0.125" steel bars, four 3' aluminum L brackets, and four force sensors attached to circuit boards. The 64 roller ball bearing assemblies (e.g., Harbor Freight, 1 in. Roller Ball Bearing) are screwed down in an equidistant 8×8 grid across the bottom plywood board. The eight steel bars are screwed into the underside of the top plywood board, in parallel, aligned directly on top of the same 8×8 grid as the ball bearing rollers. The top plywood board lays directly on top of the bottom plywood board with the steel tracks on the underside of the top board providing a frictionless surface for the ball bearings to move and prevents potential indentations in the plywood. All four aluminum L brackets are also screwed down to the bottom plywood boards along the four edges and extended very slightly off the platform. Force sensors are attached to the center of the aluminum L brackets along all four sides of the bottom board.

Alternatives to using ball-bearing rollers or other bearing assemblies to provide a low friction interface between the top and bottom boards are: (1) A polymer gel with low lateral or shear force viscosity such as SHOCKtec® Gel, from Shocktec, Inc.; (2) an air bearing surface; (3) a captured liquid interface (e.g., similar to a waterbed) placed between the top and bottom surface. All these alternatives have low lateral resistance to small displacements of the top surface platform and allow the lateral force to be applied directly to the force sensor, similar to the bearing assembly design mentioned above.

As a user moves while on the platform, the extra space provided by the L brackets allows very slight movements of the top board which pushes the board into the force sensor pressure plates in the corresponding direction of the forces applied. The roller ball assemblies allow movement—and detection of forces—in all 4 directions simultaneously. The amount of movement is virtually undetectable by the user to prevent compensatory movements to stabilize the board and can provide an experience as similar as possible to kinesthetic movement across flat ground. These forces are recorded as "North, South, East, or West" horizontal forces and the total horizontal force can be calculated by combining the force vectors recorded by each direction during the contact with the board.

Figure 23:
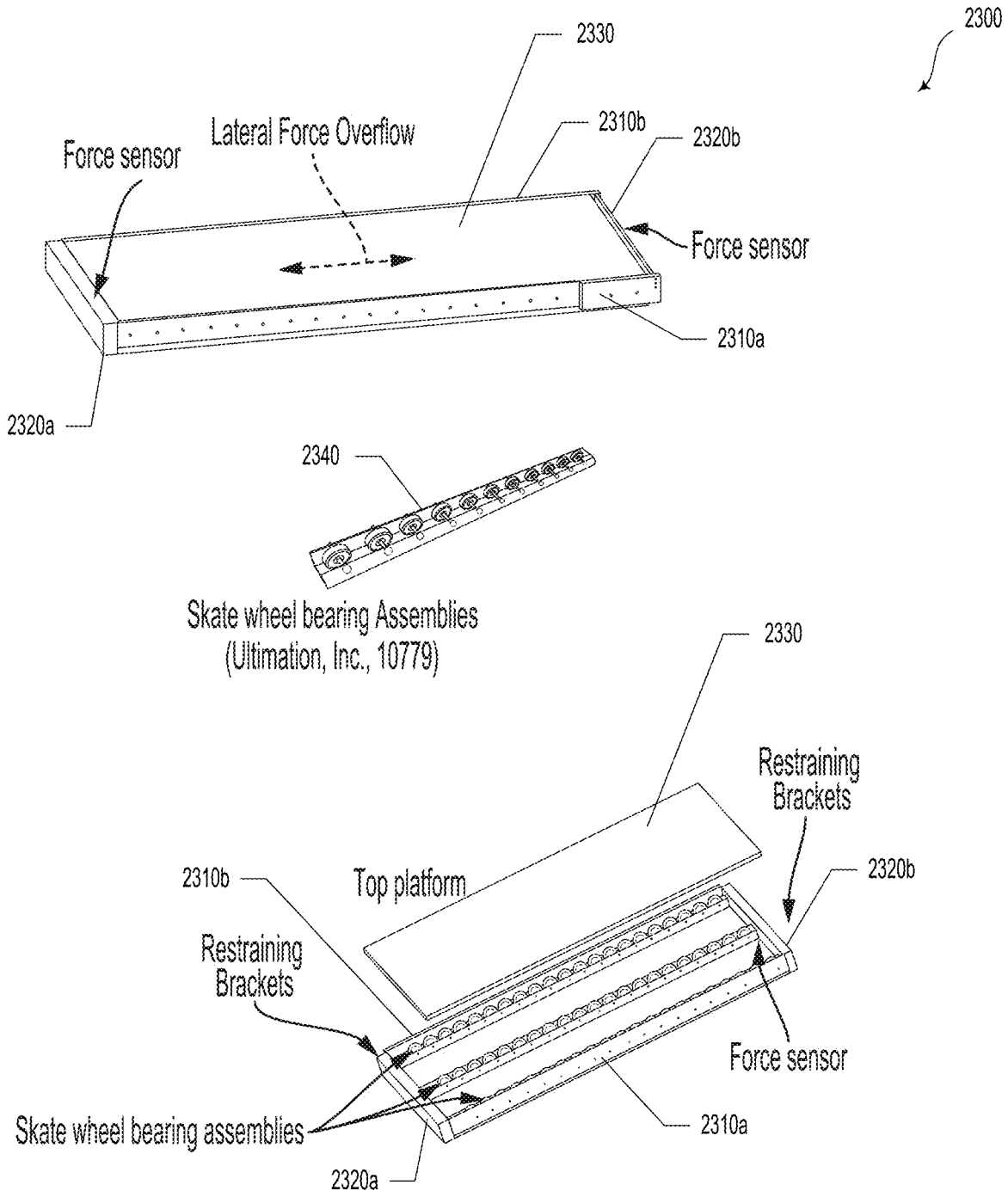
FIG. 23 illustrates a one-dimensional lateral force transducer system, according to an example embodiment.

FIG. 23 illustrates a one-dimensional lateral force transducer system 2300, according to an example embodiment. Lateral force platforms can be constructed using or cylindrical bearing assemblies (Skate Wheel, Ultimation, 5 foot, conveyor rails, 10779). Skate wheel assemblies 2340 allow force measurements both along the direction of motion and in the opposite direction. They also provide a greater contact area between the bearing surface and the top platform 2330 reducing the possibility of wear. By taking readings from multiple sensors, force vectors in any direction can be measured.

In some embodiments, the side restraining brackets 2310*a* and 2310*b* parallel to the lateral force flow in FIG. 23 could include a low friction covering or coating, such as polytetrafluoroethylene (PTFE), to reduce frictional forces that might impede the lateral motion of the top platform 2330. Additionally or alternatively, the side restraining brackets 2310*a* and 2310*b* could incorporate wheel bearing assemblies 2340 to constrain the side-to-side motion of the top platform 2330 but still allow low friction movement in the lateral direction.

In some embodiments, the force sensor restraining brackets 2320*a* and 2320*b* illustrated in FIG. 23 could incorporate a compressible elastomer sheet or mechanical spring assemblies. The clamping force applied to the restraining brackets 2320*a* and 2320*b* during assembly of the lateral force platform can provide an adjustable preloading of the force sensors; that is, they will register a force with no additional lateral force applied to the top platform. This embodiment of the lateral force platform will allow each force sensor to measure additional forces applied to the top platform in either the forward or reverse directions.

The particular arrangements shown in the Figures should not be viewed as limiting. It should be understood that other embodiments may include more or less of each element shown in a given Figure. Further, some of the illustrated elements may be combined or omitted. Yet further, an illustrative embodiment may include elements that are not illustrated in the Figures.

A step or block that represents a processing of information can correspond to circuitry that can be configured to perform the specific logical functions of a herein-described method or technique. Alternatively or additionally, a step or block that represents a processing of information can correspond to a module, a segment, a physical computer (e.g., a field programmable gate array (FPGA) or application-specific integrated circuit (ASIC)), or a portion of program code (including related data). The program code can include one or more instructions executable by a processor for implementing specific logical functions or actions in the method or technique. The program code and/or related data can be stored on any type of computer readable medium such as a storage device including a disk, hard drive, or other storage medium.

The computer readable medium can also include non-transitory computer readable media such as computer-readable media that store data for short periods of time like register memory, processor cache, and random access memory (RAM). The computer readable media can also include non-transitory computer readable media that store program code and/or data for longer periods of time. Thus, the computer readable media may include secondary or persistent long term storage, like read only memory (ROM), optical or magnetic disks, compact-disc read only memory (CD-ROM), for example. The computer readable media can also be any other volatile or non-volatile storage systems. A computer readable medium can be considered a computer readable storage medium, for example, or a tangible storage device.

While various examples and embodiments have been disclosed, other examples and embodiments will be apparent to those skilled in the art. The various disclosed examples and embodiments are for purposes of illustration and are not intended to be limiting, with the true scope being indicated by the following claims.

What is claimed is:

1. A system comprising:

a punching bag;

a plurality of force sensors coupled to the punching bag, wherein the force sensors are configured to detect physical impacts on the punching bag, wherein the physical impacts comprise a punch, a kick, or another physical strike;

a plurality of light-emitting devices coupled to the punching bag, wherein the plurality of light-emitting devices is configured to indicate strike targets on the punching bag;

a lateral force transducer system, the lateral force transducer system comprising:

a base plate;

a top plate;

a plurality of friction-reducing elements, wherein the top plate and the base plate are slidably coupled by way of the plurality of friction-reducing elements; and a plurality of lateral force sensors configured to measure the amplitude of the lateral force; and a controller having at least one processor and a memory, wherein the at least one processor executes program instructions stored in the memory so as to carry out operations, the operations comprising:

causing one or more light-emitting devices of the plurality of light-emitting devices to indicate strike targets;

receiving, from at least one of the force sensors, information indicative of one or more physical impacts proximate to the strike targets;

receiving, from the lateral force transducer system, information indicative of an amplitude of a lateral force; and determining, based on the information received from the force sensors and the lateral force transducer system, a peak force, a jerk time, a momentum value, and a reaction time.

2. The system of claim 1, wherein the plurality of force sensors is further configured to provide information indicative of a user input, wherein the operations further comprise determining, based on the information indicative of the user input, a desired operating mode from among a plurality of user-selectable operating modes.

3. The system of claim 2, wherein the user-selectable operating modes comprise at least one of: a random operating mode, a workout mode, a group class mode, a proficiency-dependent mode, an activity-specific mode, or a reaction time measurement mode.

4. The system of claim 1, further comprising a graphical user interface configured to dynamically display at least one of: punch information of participants in a streaming boxing class, a live video of a boxing class instructor, a live video of other boxing class participants, or a boxing class leaderboard.

5. The system of claim 1, further comprising:

a camera configured to record the physical strikes; and a display, wherein the operations further comprise providing, via the display, a video replay of a user-selected physical strike.

6. The system of claim 1, further comprising:

a multi-layer structure coupled to the punching bag, wherein the multi-layer structure comprises:

a first impact-absorbing layer;

a second impact-absorbing layer, and a device layer disposed between the first impact-absorbing layer and the second impact-absorbing layer, wherein the plurality of force sensors and the plurality of light-emitting devices are incorporated onto the device layer of the multi-layer structure.

7. The system of claim 1, wherein the plurality of lateral force sensors is configured to measure the amplitude of the lateral force along one- or two-dimensions.

8. A method comprising:

causing one or more light-emitting devices of a plurality of light-emitting devices to indicate strike targets;

receiving, from at least one force sensor, information indicative of one or more physical impacts proximate to the strike targets, wherein the at least one force sensor is coupled to a device body, wherein the one or more physical impacts comprise a punch, a kick, or another physical strike;

receiving, from a lateral force transducer system, information indicative of an amplitude of a lateral force, wherein the lateral force transducer system comprises:

a base plate;

a top plate;

a plurality of friction-reducing elements, wherein the top plate and the base plate are slidably coupled by way of the plurality of friction-reducing elements; and a plurality of lateral force sensors configured to measure the amplitude of the lateral force; and determining, based on the information received from the force sensors and the lateral force transducer system, a peak force, a jerk time, a momentum value, and a reaction time.

9. The method of claim 8, further comprising causing the one or more light-emitting devices of the plurality of light-emitting devices coupled to the device body to indicate a plurality of user-selectable operating modes, wherein the user-selectable operating modes comprise at least one of: a random operating mode, a workout mode, a group class mode, a proficiency-dependent mode, an activity-specific mode, or a reaction time measurement mode.

10. The method of claim 8, further comprising:

receiving, from the at least one force sensor, information indicative of a user input; and determining, based on the received information, a desired operating mode.

11. The method of claim 8, further comprising:

dynamically displaying, via a graphical user interface, at least one of: punch information of participants in a streaming boxing class, a live video of a boxing class instructor, a live video of other boxing class participants, or a boxing class leaderboard.

12. The method of claim 8, further comprising:

determining, based on the received information, at least one of: a type of the physical impact or a location of the physical impact.

13. A device comprising:

a device body configured to be removably coupled to a coupling surface;

at least one force sensor coupled to the device body, wherein the at least one force sensor is configured to detect physical impacts to the coupling surface;

a plurality of light-emitting devices coupled to the device body, wherein the plurality of light-emitting devices is configured to indicate strike targets; and a controller having at least one processor and a memory, wherein the at least one processor executes program instructions stored in the memory so as to carry out operations, the operations comprising:

causing one or more light-emitting devices of the plurality of light-emitting devices to indicate strike targets;

receiving, from the at least one force sensor, information indicative of one or more physical impacts proximate to the strike targets;

receiving, from a lateral force transducer system, information indicative of an amplitude of a lateral force, wherein the lateral force transducer system comprises:

a base plate;

a top plate;

a plurality of friction-reducing elements, wherein the top plate and the base plate are slidably coupled by way of the plurality of friction-reducing elements; and a plurality of lateral force sensors configured to measure the amplitude of the lateral force; and determining, based on the information received from the force sensors and the lateral force transducer system, a peak force, a jerk time, a momentum value, and a reaction time.

14. The device of claim 13, wherein the operations further comprise:

transmitting the peak force, the jerk time, the momentum value, and the reaction time to a remote computing device configured to aggregate information received from a plurality of force-sensing devices.

15. The device of claim 14, wherein the device is configured to transmit the peak force, the jerk time, the momentum value, and the reaction time to the remote computing device for use in a group training scenario.

16. The device of claim 13, further comprising a second device body and at least one second force sensor, wherein the operations further include:

receiving, from the at least one second force sensor, information indicative of a physical strike on the second device body; and determining, based on the received information, a relative strike time difference between the one or more physical impacts on the device body and the physical strike on the second device body.

17. The device of claim 13 further comprising an audio sensor, wherein the operations further comprise:

receiving, from the audio sensor, information indicative of a user input or an audio trigger; and determining, based on the received information, a desired operating mode or a reference time.

18. The device of claim 13, wherein at least a portion of the device body comprises an adhesive surface configured to couple the device body to the coupling surface.

19. The device of claim 13, further comprising:

a multi-layer structure, wherein the multi-layer structure comprises:

a first impact-absorbing layer;

a second impact-absorbing layer, and a device layer disposed between the first impact-absorbing layer and the second impact-absorbing layer, wherein the plurality of force sensors and the plurality of light-emitting devices are incorporated onto the device layer of the multi-layer structure.

* * * * *